US012351774B2

(12) United States Patent
Assanelli et al.

(10) Patent No.: US 12,351,774 B2
(45) Date of Patent: Jul. 8, 2025

(54) FRICTION REDUCING ADDITIVES AND PROCESS FOR PREPARING THE SAME

(71) Applicant: ENI S.P.A., Rome (IT)

(72) Inventors: Giulio Assanelli, San Donato Milanese (IT); Marcello Notari, San Donato Milanese (IT); Paolo Cambise, San Donato Milanese (IT); Andrea Pucci, Pisa (IT); Giuseppe Iasilli, Ghezzano—San Giuliano Terme (IT)

(73) Assignee: ENI S.P.A., Rome (IT)

( * ) Notice: Subject to any disclaimer, the term of this patent is extended or adjusted under 35 U.S.C. 154(b) by 0 days.

(21) Appl. No.: 18/022,894

(22) PCT Filed: Aug. 25, 2021

(86) PCT No.: PCT/IB2021/057788
§ 371 (c)(1),
(2) Date: Feb. 23, 2023

(87) PCT Pub. No.: WO2022/043891
PCT Pub. Date: Mar. 3, 2022

(65) Prior Publication Data

US 2023/0340358 A1 Oct. 26, 2023

(30) Foreign Application Priority Data

Aug. 26, 2020 (IT) ..... 102020000020482

(51) Int. Cl.
*C10M 159/12* (2006.01)
*C10M 177/00* (2006.01)

(52) U.S. Cl.
CPC ..... *C10M 159/12* (2013.01); *C10M 177/00* (2013.01); *C10M 2215/00* (2013.01)

(58) Field of Classification Search
CPC ..... C10M 159/12; C10M 177/00; C10M 2215/00; C10M 133/02; C10M 2203/1025;
(Continued)

(56) References Cited

U.S. PATENT DOCUMENTS 4,617,133 A 10/1986 Horodysky et al.
4,816,037 A 3/1989 Horodysky et al.
(Continued)

FOREIGN PATENT DOCUMENTS

CA 2528380 A1 * 5/2006 ..... C10M 163/00
CA 2679947 A1 * 9/2008 ..... C10M 133/04
(Continued)

OTHER PUBLICATIONS

"Engine Oil Licensing and Certification System" (APIEOLCS, 1507—Industry Services Department, Fourteenth Edition, Dec. 1996, Addendum 1, Dec. 1998.
(Continued)

*Primary Examiner* — Cephia D Toomer
(74) *Attorney, Agent, or Firm* — CANTOR COLBURN LLP

(57) ABSTRACT

A friction reducing additive is described formed by a mixture that is obtainable by autocatalytic condensation reaction of fatty acids with alkanolamines. The mixture includes an amide, one or more esters of carboxylic acids, and an oxazoline in an amount greater than 7% by weight with respect to the total weight of the mixture, wherein the additive may be used both in lubricants and in fuels.

11 Claims, 8 Drawing Sheets stability tests; positive result (case a, b) and negative result (case c)

(58) Field of Classification Search
CPC ..... C10M 2215/04; C10M 2215/042; C10M 2215/08; C10M 2215/082; C10M 2215/225; C10L 10/08; C10L 1/2225; C10L 1/224; C10L 1/233; C10L 2200/0423; C10L 2270/02; C10L 2270/023; C10L 1/22; C10N 2020/081; C10N 2030/06; C10N 2030/42; C10N 2030/43; C10N 2030/45; C10N 2030/54; C10N 2030/56; C10N 2040/04; C10N 2040/25; C10N 2040/255
See application file for complete search history.

(56) References Cited

U.S. PATENT DOCUMENTS

| | | | |
|---|---|---|---|
| 5,334,329 | A | 8/1994 | Vinci et al. |
| 9,562,207 | B2 | 2/2017 | Deblase et al. |
| 2007/0094921 | A1 | 5/2007 | Colucci et al. |
| 2010/0132253 | A1 | 6/2010 | Kaufman et al. |
| 2010/0210487 | A1 | 8/2010 | Deblase et al. |
| 2011/0162263 | A1 | 7/2011 | Vilardo et al. |
| 2015/0038385 | A1 | 2/2015 | Barton et al. |

FOREIGN PATENT DOCUMENTS

| | | | |
|---|---|---|---|
| EP | 2746370 | A1 | 6/2014 |
| KR | 20140066663 | A | 6/2014 |

OTHER PUBLICATIONS

International Search Report for International Application No. PCT/IB2021/057788, International Filing Date Aug. 25, 2021, Date of Mailing Dec. 8, 2021, 4 pages.
Koshima, H. et al. "Analyses of the Adsorption Structures of Friction Modifiers by Means of Quantiative Structure- Property Relationship Method and Sum Frequency Generation Spectroscopy", Tribology Online, vol. 5, No. 3 (2010), 165-172.
Lattuada, M. et al., "A new methodology for the experimental evaluation of organic antifriction additives"—ISFL—2016 10th International Symposium on Fuels and Lubricants 11 pages.
Phillips, B.S., et al., "Ionic liquid lubrication effects on ceramics in a water environment" Tribology Letters, vol. 17, No. 3, Oct. 2004, 533-541.
Sharma, B.K. et al., "Ester hydroxy derivatives of methyl oleate: tribological, oxidation and low temperature properties", Bioresource Technology, 99 (2008) 7333-7340.
Sharma, B.K., et al. "Oxidation, friction reducing, and low temperature properties of epoxy fatty acid methyl esters", Green Chemistry, published Feb. 12, 2007, 6 pages.
Spikes, H., "Friction Modifier Additives", Tribol Lett (2015) 60:5, DOI 10.1007/s11249-015-0589, 13 pages.
Written Opinion for International Application No. PCT/IB2021/057788, International Filing Date Aug. 25, 2021, Date of Mailing Dec. 8, 2021, 7 pages.
UAE Office Action Summary (Examination Results) for UAE patent application P6000385/2023, dated Feb. 20, 2025.
Saudi Arabian First Substantive Examination Report for SA Patent No. 523442584; dated Apr. 14, 2025.

* cited by examiner

Figure 1: stability tests; positive result (case a, b) and negative result (case c)
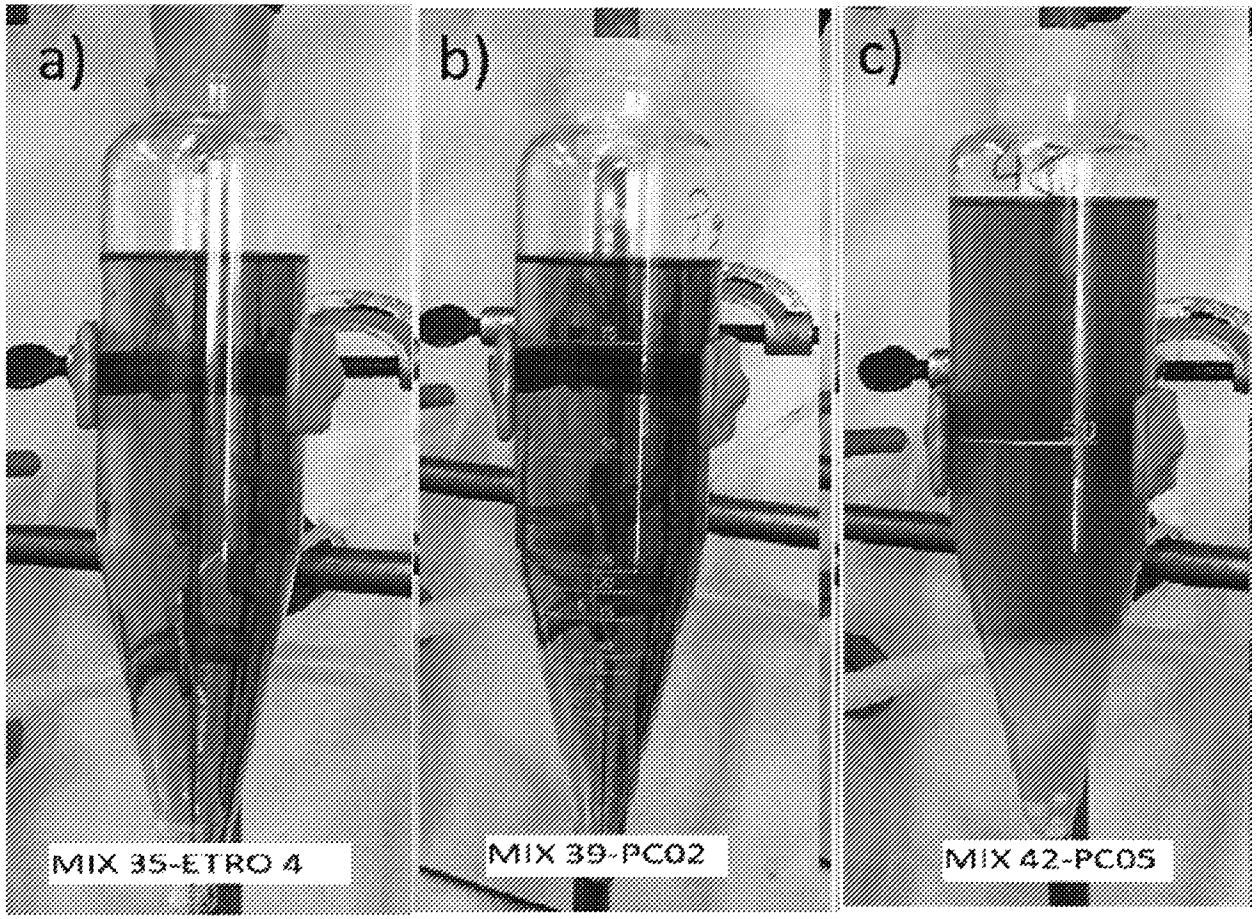

Figure 2: Stribeck curves at a temperature of 45°C
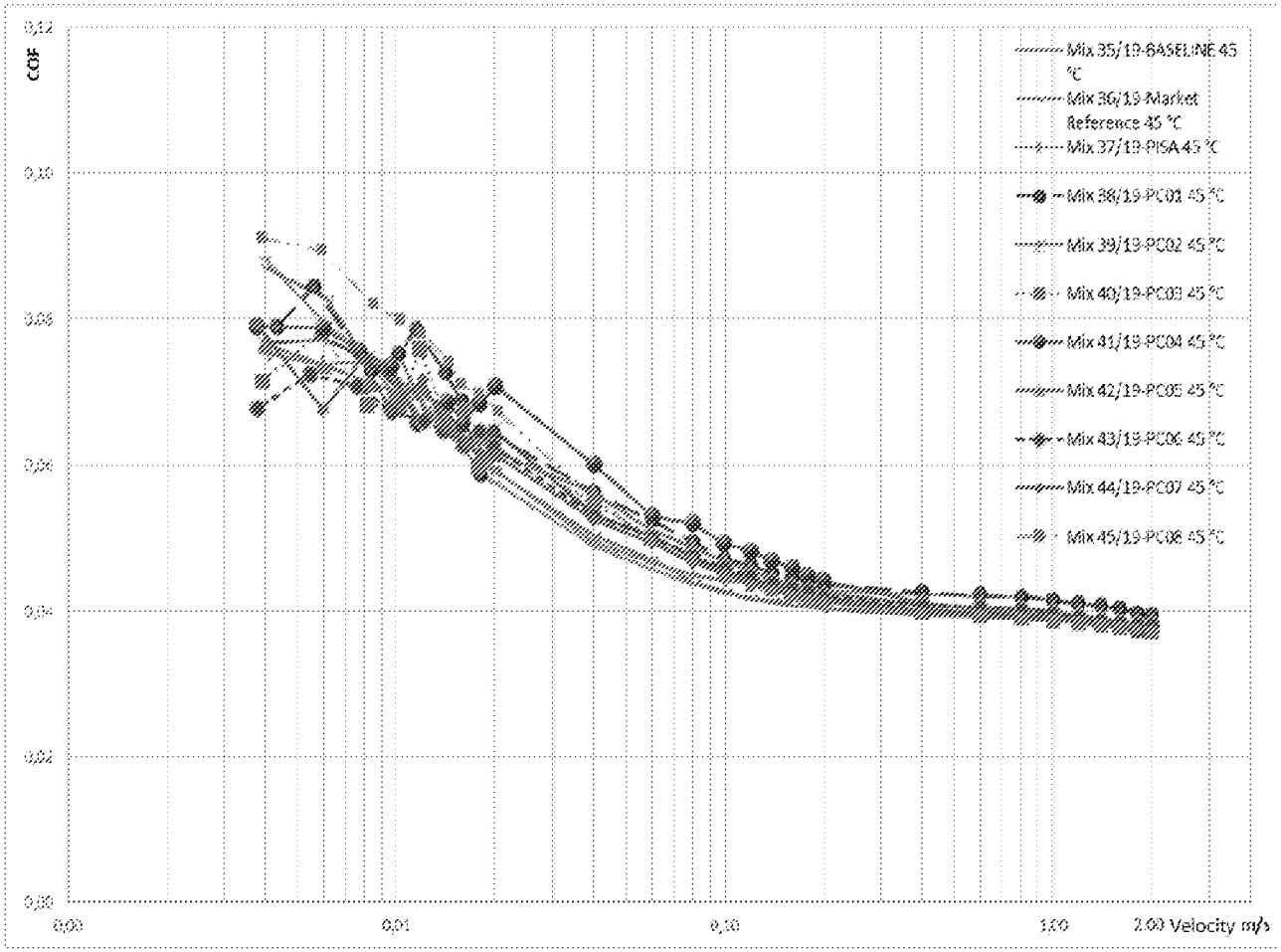

Figure 3: Stribeck curves at a temperature of 120°C
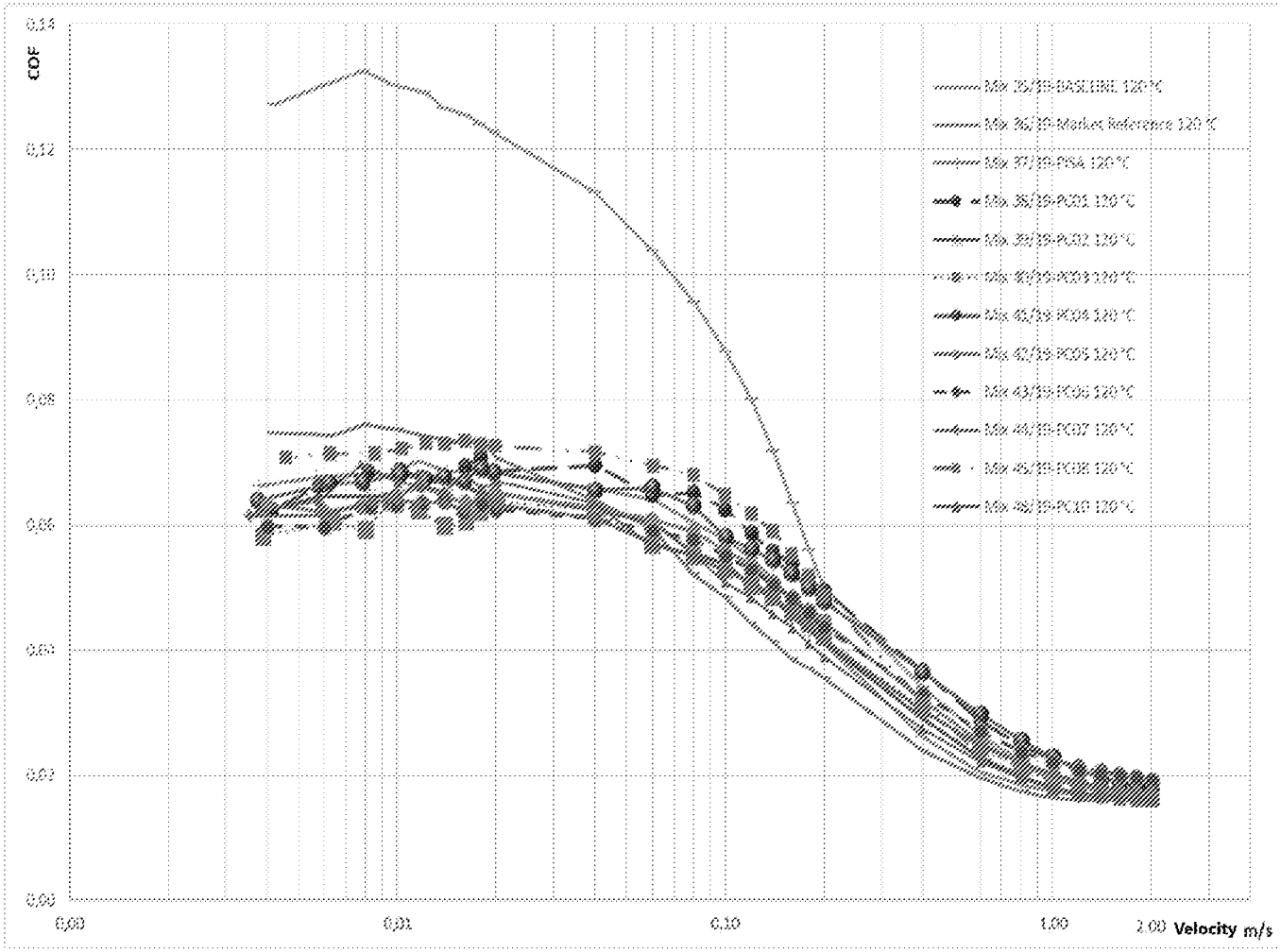

Figure 4: Stribeck curves at a temperature of 150°C
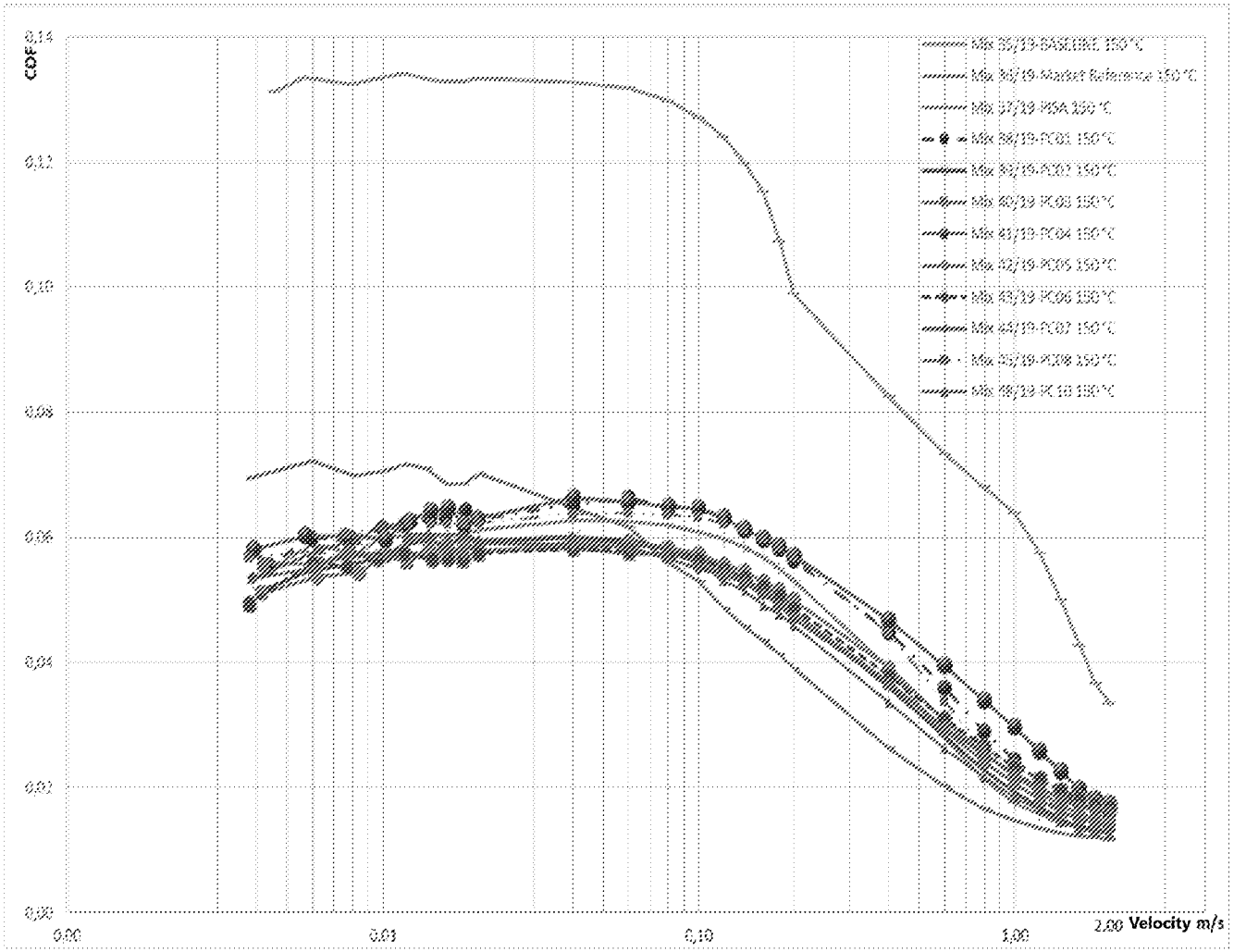

Figure 5: SRV tests "no harm" between lubricants with additives and Mix 35/19 (blank)
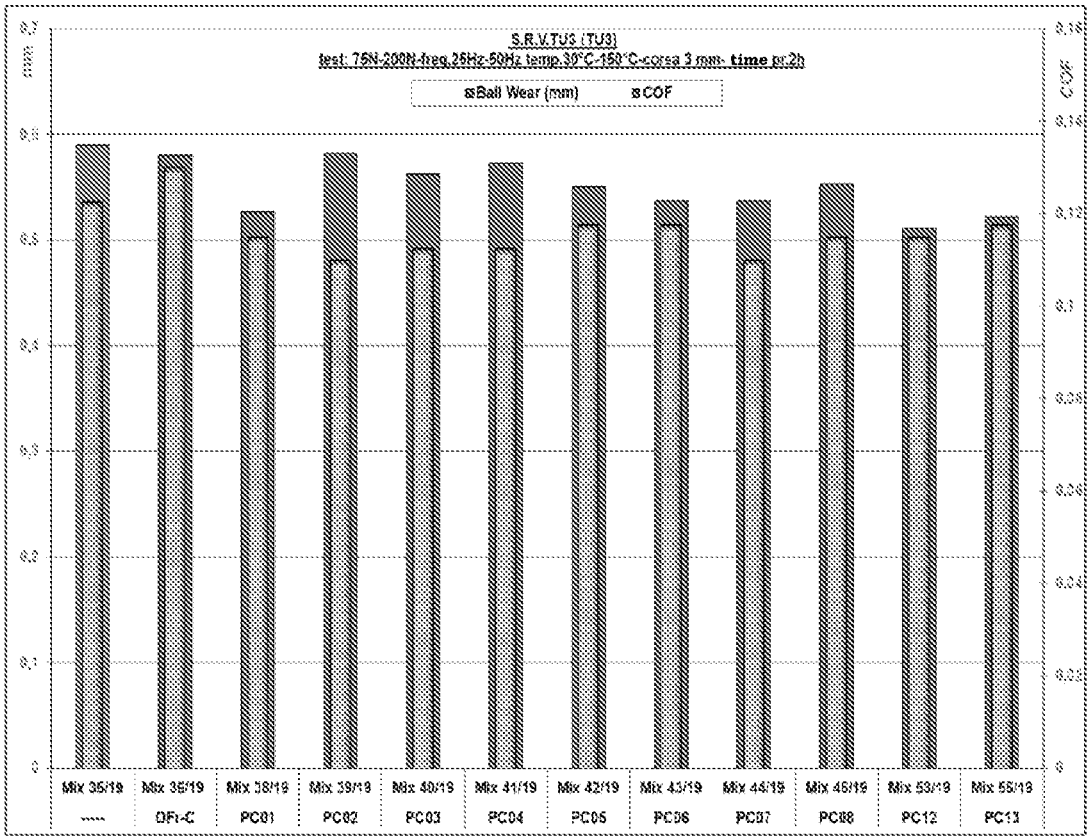

Figure 6: couplings of the HFRR test
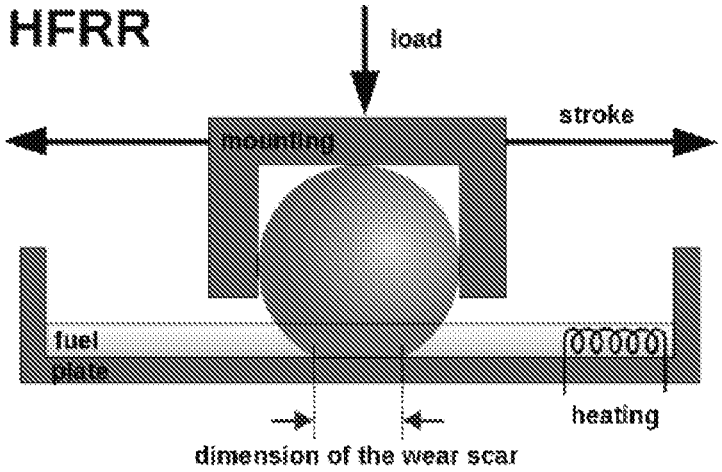
Figure 7: steel ball and disc couplings in the MTM test
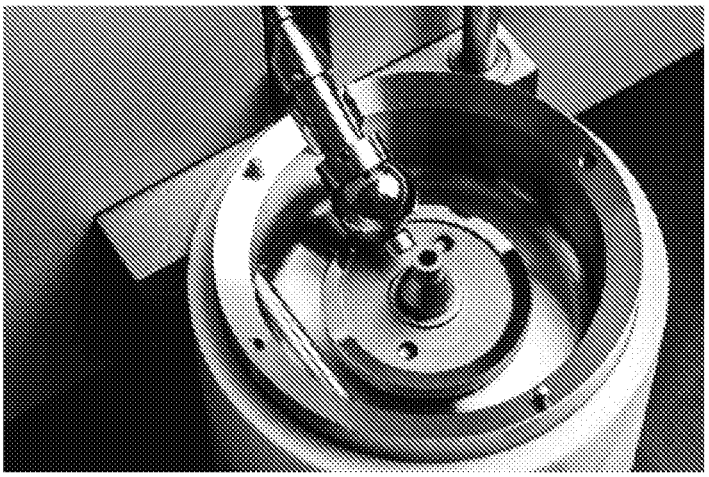

FRICTION REDUCING ADDITIVES AND PROCESS FOR PREPARING THE SAME

CROSS-REFERENCE TO RELATED APPLICATIONS

The present application is a 35 U.S.C. § 371 National Stage patent application of International patent application PCT/IB2021/057788, filed on 25 Aug. 2021, which claims priority to Italian patent application 102020000020482, filed on 26 Aug. 2020, the contents of which are incorporated herein by reference in their entirety.

TECHNICAL FIELD

The present disclosure relates to friction reducing additives, mainly deriving from renewable sources, suitable for use in lubricating compositions and fuels, including those of bio-renewable origin and in lubricants, such as for example those for motor vehicles and in particular Low and mid Saps lubricants (low and medium content of sulphated ash, phosphorus and sulfur).

In particular, the present disclosure relates to additives as defined above which are able to advantageously reduce the friction in the mechanical moving parts of machinery, and in particular of engines, increasing their energy efficiency and therefore reducing the exhaust emissions of carbon dioxide.

Even more particularly, the present disclosure relates to friction reducing additives formed by a mixture of organic compounds, not containing metals, in the form of amide, one or more esters of carboxylic acids and oxazoline, said mixture having a high degree of bio-renewability as it can be obtained from fatty acids and alkanolamines derived from renewable sources.

BACKGROUND

The reduction of $CO_2$ emissions is a global challenge that concerns the sector related to the production and consumption of energy.

In the European Union, it is estimated that about 30% of total $CO_2$ emissions come from the transport sector, and of this total, 72% is caused by "road transport" divided as follows:

1.2% motorcycles
26.2% trucks (heavy duty trucks)
11.9% light duty trucks
60.7% cars.

For the reasons described above, the European Union has set new legal limits such that, starting from 2021, $CO_2$ emissions from cars must be equal to or less than 95 g $CO_2$/Km.

Manufacturers, again starting from 2021, will therefore have to offer engines on the market capable of guaranteeing a consumption/distance ratio (the so-called fuel economy) of 4.1 1/100 km (Otto-cycle engines) and 3.6 1/100 km (diesel engines).

In this context, fuels and lubricants of bio-renewable origin capable of guaranteeing vehicles a lower environmental impact will be particularly favored.

Regarding internal combustion engines, it should be remembered that only 15% (data from the American Department of Energy) of the energy introduced in a car through the fuel is used to generate the movement of the car on the road.

The remaining percentage of energy (85%) is lost and is distributed as follows:

20% of energy for starting the engine, for keeping the engine at idle speed and for auxiliary systems (air conditioning and other electrical devices);
35% of the energy heat generated by the thermodynamic cycle of the engine;
30% of energy lost as friction in turn divided into friction in the parts that make up the engine and the transmission apparatus (20%), brake friction (5%) and tire friction (5%).

Of the amount of energy dissipated as friction, it is estimated that about 67% is lost due to the effect of friction in the engine and in the transmission components.

The friction, responsible for these reductions in energy efficiency, originates in the parts of the engine affected in different operating conditions of load, speed and temperature.

Following this, research has for some time been focused on reducing the energy losses generated by the friction present both in the internal combustion engine and in its transmission system.

One of the objectives of this research is to reduce the coefficient of friction (COF) between the various moving parts, without compromising their operation and duration over time.

The reduction of COF is generally obtained both by acting on the rheological properties of the lubricant (by decreasing its viscosity) and by using suitable additives, such as "Friction Reducers" (FRs), detergents and modifiers of the viscosity index.

In fact, by reducing the COF there is a reduction in the amount of energy dissipated, and therefore a greater fuel economy value (distance traveled/fuel used): this leads to lower fuel consumption per distance traveled and therefore lower $CO_2$ emissions.

The fuel economy is therefore the reference parameter with which fuels and lubricants are classified as regards their energy efficiency and consequent environmental impact (for example, reduction of $CO_2$ emissions).

The additives called "Friction Reducers" (FRs), are mainly organic molecules (OFRs), generally amphiphilic, characterized by a hydrocarbon backbone ($>C_{16}$) and a polar head, such as glycerol mono oleate (GMO), or are metal-organic molecules (MOFRs) as such for example molybdenum dithiocarbamate (MoDTC).

To date, lubricants use both organic metal (MOFRs) and purely organic (OFRs) Friction Reducers (FRs).

The most promising are purely organic additives because they are more compatible with the most modern exhaust gas post-treatment devices called "Diesel particulate Filter" (DPF) and "Gasoline particulate Filter" (GPF).

These filters are able to block the exit of PM (Particle Matters) into the atmosphere, thus contributing to the reduction of emissions: however, both DPF and GPF trap not only the particulate but all the solids emitted at the exhaust, including the residues of the combustion, coming from the portion of lubricant drawn into the combustion chamber.

To avoid clogging of the filter, it is therefore necessary to carry out regeneration cycles at high temperatures (>600° C.) in order to eliminate all the carbonaceous substances present on the filter.

The metallic elements of the lubricant, subjected to high temperatures, form solid compounds (the so-called 'ashes') which cannot be burned.

The metals in lubricant additives therefore accumulate in the filter pores without being able to be removed during a normal regeneration cycle.

For this reason it is desirable to have "Organic Friction Reducers (OFRs)" additives, free of metallic elements, sulfur and phosphorus, which can originate "LOW SAPS" (Sulphated Ash, Phosphorus and Sulfur) lubricating oils, i.e. low in sulphated ash, phosphorus and sulfur. The lubricants obtained in this way have greater compatibility with DPF and GPF filters, greatly delaying the occlusion of the pores.

The evaluation of the reduction of the coefficient of friction (COF) by an additive "Friction Reducer" (FRs) takes place thanks to the usage of one or more suitable tribological tests.

These laboratory tests allow to estimate the friction and wear, related to a lubricant or a fuel, by means of specific measures as reported in the following table (see also the characterization in the examples), and the positive result achieved in all tests is a prerequisite for subjecting the lubricant or fuel with additives to the much more expensive and burdensome engine tests.

| TRIBO TEST | FLUID | METHOD | MEASURE |
|---|---|---|---|
| HFRR | Gasoline | ISO 12156-1 adapted for gasoline | Wear area (microns) |
| SRV | Lubricant | Internal method | COF + ball wear diameter |
| MTM | Lubricant | Internal method | COF |

The HERR (High frequency reciprocating rig) test allows to evaluate the lubricity exerted by the fuel, diesel in general but also gasoline, evaluated as a wear index: the lower this value is, the more optimal the behavior of the fuel is considered.

The SRV test ("Schwingung Reibung und Verschleiss", or "oscillating, friction and wear"), applied only to lubricants, presents couplings between ball and surface similar to the HERR test but the operating conditions, developed internally by the Applicant, are decidedly more severe.

At the end of the test, as an instrumental response, a coefficient of friction (COF, is dimensionless value) obtained and the wear is measured (mm): also in this case, low COF and wear values indicate an optimal behavior of the lubricant.

Another important tribological test involves the usage of a rig called "Mini Traction Machine" (MTM).

Also in this test the COF is measured using a coupling between a loaded steel ball against a steel disc, in any sliding/rolling ratio up to 100% pure rolling.

See M. Lattuada, M. Manni "*A new methodology for the experimental evaluation of organic antifriction additives*"-10$^{th}$ INTERNATIONAL SYMPOSIUM ON FUELS AND LUBRICANTS.

Since in such a coupling the contact pressures and the cutting velocities can reach high values, very similar to those found, for example, in gears, rolling bearings and cams, typical of an internal combustion engine (ICE), such a test can provide indications very useful about the behavior of the lubricant in different lubrication regimes: hydrodynamic (high thickness of tribo film between the surfaces in contact), mixed (medium thickness of tribo film between the surfaces in contact), boundary (thin thickness of tribo film between the surfaces in contact).

The use of the "MTM" rig is particularly suitable for the construction of the Stribeck curve in which the COF is measured at different sliding velocities generated between the surfaces in contact. The area subtended by the entire Stribeck curve is known as the "Stribeck coefficient of friction" (SFC) and expresses a measure of "energy dissipation".

Excellent Fuel Economy values are therefore guaranteed by low "SFC" values, typical of lubricants capable of minimizing energy losses caused by friction (see the characterization in the examples).

Generally FRs additives are able to decrease the COF when the lubrication regime is mainly of the boundary type, that is when the rheological properties (e.g. viscosity) of the lubricant are no longer as influential as happens for the hydrodynamic regime and for the mixed (see what is described in the characterization of the examples).

The FRs additives, in the boundary regime, act according to the mechanism of the absorbed layers in which the polar parts of the molecules are attracted and anchored to the metal surface by strong absorption forces (hydrogen bonds), while the hydrocarbon parts, solubilized in the oil, are arranged perpendicular to the metal surface (see for example Tribology Online, vol 5, No 3 (2010)/166).

Furthermore, the polar parts of the FRs interact with each other through dipole-dipole interactions and the non-polar parts are kept aligned and parallel to each other by van der Waals forces. As a result of all this, the final effect consists in the formation of multi-molecular clusters capable of decreasing the coefficient of friction between the metal surfaces in the "boundary" lubrication regime.

The different types of organic FRs additives, coming from renewable raw materials, can probably be grouped into the following chemical classes:

a) Carboxylates and alcohols;

b) Amines, alkanolamines, amides and imides;

c) Polymers;

d) Ionic Liquids (ILS).

Among carboxylates and alcohols a) the best known and most used up to now are those derived from vegetable oils.

These, such as stearic acid and oleic acid, have the dual characteristic of being "environmentally friendly" and coming from renewable raw materials, but suffer from the drawback of generating possible corrosive phenomena, which do not make them compatible with lubricating oils for engines (ICE). See for example what is reported in Hugh Spikes, "Friction Modifier Additives", Tribol Lett (2015) 60:5, DOI 10.1007/s11249-015-0589.

Other FRs derived from vegetable oils and used in the past are monoglycerides, such as GMS (glycerol mono-stearate) and GMO (glycerol mono-oleate).

In more recent years, modifications to vegetable oils have been proposed, such as epoxidation, esterification, acylation, hydrogenation and alkylation to improve friction reduction performance. See for example the article of Sharma B K, Doll K M, Erhan S Z., "*Ester hydroxy derivatives of methyl oleate: tribological, oxidation and low temperature properties*.", Bioresour Technol 2008; 99:7333.

"Environmentally friendly" products have also been proposed deriving from the epoxidation of methyl esters of unsaturated fatty acids, whose interactions with metal surfaces are strong enough to provide good friction reduction properties (Sharma B K, Doll K M, Erhan S Z. "Oxidation, friction reducing, and low temperature properties of epoxy fatty acid methyl esters", Green Chem 2007; 9:469).

Other products proposed as "environmentally friendly", to be used in fuels, are those derived from the condensation of some polycarboxylic acids, such as tartaric or citric acid, with fatty alcohols and/or fatty amines (see for example US 2011/0162263 A1).

The ester derivatives, obtained from the reaction of polycarboxylic acids with fatty alcohols, although may be soluble in fuels, and possibly in lubricants, in practice they have a scarcity of "polar" sites which can determine low friction reduction performance due to their low capacity of "binding" interaction with the metal surfaces in contact.

On the other hand, the amide derivatives, obtained from the reaction of polycarboxylic acids with fatty amines, are normally not very soluble in lubricants/fuels in order to be used effectively as friction reducers.

Another renewable source with which to build environmentally friendly FRs are sugars and more generally carbohydrates.

For example, they have been proposed (see for example US 2010/0210487 A1) of the esters derived from the esterification or transesterification reaction of sorbitan with fatty acids, or with esters of fatty acids in order to obtain functionalization on the primary hydroxy as shown in the following figure:

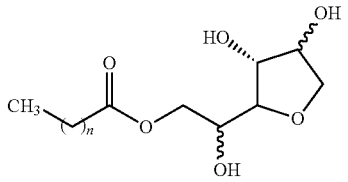

Among amines, alkanolamines, amides and imides b) capable of reducing friction, fatty amines from renewable raw materials can be mentioned, but also amino-alcohol-esters, derived from fatty acids described in US 2010/0132253 A1, having formula

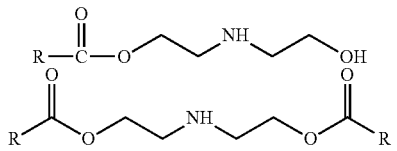

Also on this kind of molecules, destined to be used in fuels, a strongly polar portion is missing which compromises the surface binding.

Another example of type b) products is represented by amino alcohols obtained from fatty amines and derivatives of glycerin, such as for example those obtained by reaction of derivatives of 1,2 propandiol and fatty amines, represented by the following formula

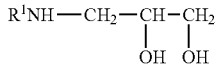

These products, described in U.S. Pat. No. 4,816,037, are particularly effective in reducing friction but have the drawback of being obtained from fatty amines and toxic compounds, such as glycidol, or chloro-propanediol.

Amides and alkanolamides are also known to be used as FRs in fuels as described in US2007/0094921A1: oleyl amide, which can be considered the progenitor of this family is quite effective in reducing friction, but in the tests carried out it was proved difficult to dissolve in lubricating oil.

Lubrication is in fact a complex process and an additive, as well as a lubricant, or their combination, is not necessarily capable to be stable and effective in any condition/situation.

Imides have also been studied as additives friction modifiers indicated for transmission oils, in particular those based on succinimides with an oil-soluble hydrocarbon chain and having a structure similar to the following

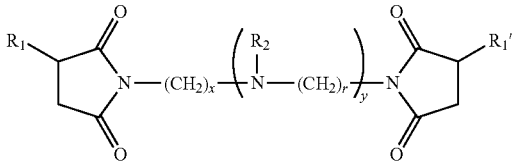

These molecules may be suitable for a transmission fluid, but are not very suitable for a "PCMO" (passenger car motor oil) lubricant wherein additives with a strong surface binding capacity are preferred (generally due to a strongly polar end), in addition to the solubility in the lubricant (generally due to an end of suitable length, for example at least 16 and not exceeding 24 carbon atoms).

Among the polymers c) can be mentioned recently commercialized polymeric products, such as those of Croda (trade name: Perfad), which are polyesters with a complex structure, containing only carbon, hydrogen and oxygen.

However, for such products, the retention of the friction-reducing properties following the aging of the lubricant (oxidation test) is not satisfactory.

Furthermore, in general, polymeric products suffer from the drawback of not having a high degree of bio-renewability.

Among ionic liquids (ILs) d), which are salts with low melting temperature and liquids at room temperature, for example the compounds based on alkyl imidazolium salts, of formula

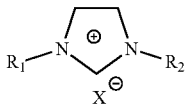

$X = PF_6$
$X = BF_4$
$X = N(CF_3SO_2)_2$
$X = CF_3SO_3$

However, the presence of $BF_4$ and $PF_6$ anions facilitate the absorption of water, with consequent hydrolysis and formation of hydrofluoric acid which can cause corrosion and thermochemical reactions (Phillips B, Zabinski J. "Ionic liquid lubrication effects on ceramics in a water environment.", Tribol Lett 2004; 17:533). Furthermore, the halogen contained in the anions can cause the formation of hydrogen halides, which are corrosive and highly toxic to the environment.

ILs in general suffer from the drawback of having a low degree of bio-renewability in addition to relatively high cost for their production due to the complicated synthesis procedure.

For this reason, the possibility of making cheaper ILs based on ammonium alkylbenzene sulfonates with the following structure has been evaluated

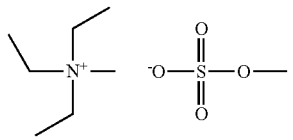

However, the presence of sulfur limits its use in "Low Saps" lubricants.

The following figures are exemplary embodiments.

FIG. 1 depicts results of stability tests for lubricant mixes, in which FIG. 1*a* (Comp. Ex. 11, Mix 35, reference blank) and FIG. 1*b* (Ex. 15, Mix 39-PC02) illustrate positive results, and FIG. 1*c* (Ex. 18, Mix 42-PC05) illustrates a negative result.

FIG. 2 depicts Stribeck curves at a temperature of 45° C. for Mixes 35-45.

FIG. 3 depicts Stribeck curves at a temperature of 120° C.

FIG. 4 depicts Stribeck curves at a temperature of 150° C.

FIG. 5 depicts SRV tests "no harm" between lubricants with additives and Mix 35/19 (blank).

FIG. 6 schematically illustrates the couplings of the HERR test.

FIG. 7 is a photo of the coupling between a steel ball loaded against a steel disc in the MTM test.

Figure 8:
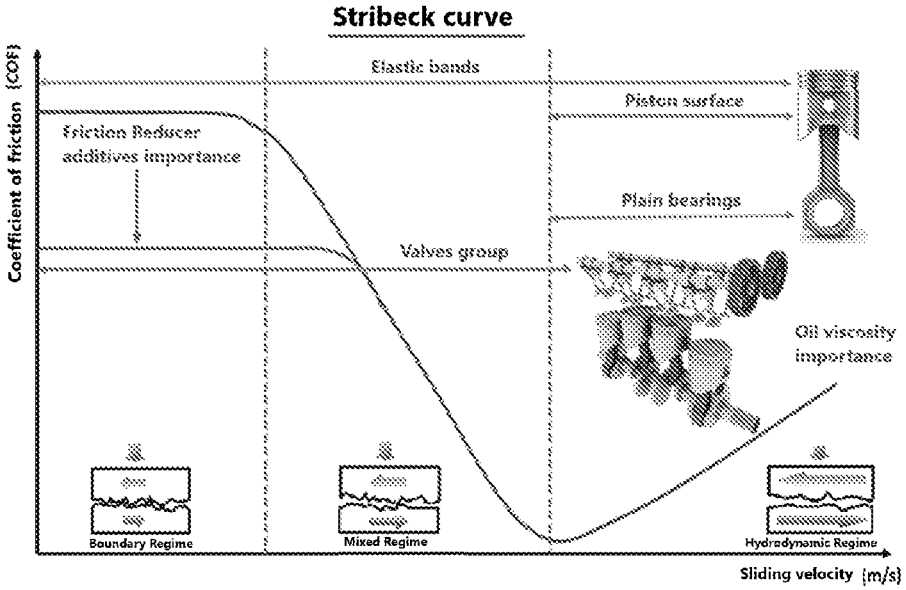

FIG. 8 schematically illustrates the Stribeck curve with boundary, mixed, and hydrodynamic lubrication regimes indicated.

Figure 9:
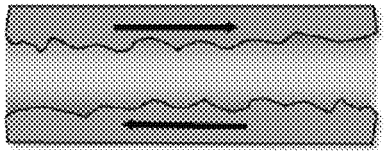

FIG. 9 schematically illustrates the "hydrodynamic" lubrication regime in which a lubricant film (intermediate layer) is thick enough to completely separate two surfaces (opposite outer layers), avoiding contact between the two surfaces.

Figure 10:
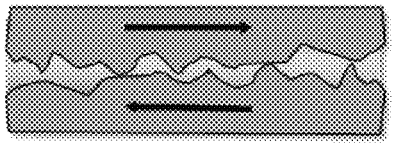

FIG. 10 schematically illustrates the "mixed" lubrication regime in which two bodies in relative motion have surface roughness and are quite close together resulting in a lower thickness lubricant film and an increase in COF.

Figure 11:
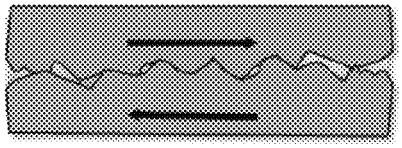

FIG. 11 schematically illustrates the "boundary" lubrication regime in which two bodies in relative motion have surface roughness and are closest together resulting in the lowest thickness of the lubricant film and a further increase in COF.

SUMMARY

The need was therefore felt to have friction reducing additives with a high degree of bio-renewability, for use in lubricating oils, including those "Low Saps" and "Mid Saps", and advantageously also in fuels, which exhibited one or more of the following properties absence of metals;
absence of sulfur;
absence of phosphorus;
absence of anions containing halogens;
stability;
not obtained from toxic materials;
solubility in lubricating oil and in fuels;
ability to maintain friction reduction properties over time;
obtained with a simple process.

The present disclosure therefore provides a friction reducing additive capable of overcoming the drawbacks that the known art complains of and having one or more of the properties indicated above.

A friction reducing additive is provided with a high degree of bio-renewability, which shows solubility in lubricants, but also in fuels, in combination with high stability and which is able to pass each of the tribological tests described above, in particular showing an improved (i.e. lower) Stribeck coefficient of friction (SEC) compared to commercially available non-metallic OFr.

The present disclosure also provides a process for preparing such a friction reducing additive which is simple, economical and easy to manage.

In accordance with these advantages, the present disclosure relates to a friction reducing additive suitable for use in lubricating oils, including "Low Saps" and "Mid Saps" ones, and also in fuels, where said additive, which does not contain metals or sulfur and phosphorus, is in the form of a mixture of organic compounds comprising an amide of formula (III), and/or one or more esters of carboxylic acids of formula (IV), And an oxazoline of formula (V), as reported below, where the oxazoline content is in an amount greater than 7%, preferably in an amount of at least 9%, by weight with respect to the total weight of the mixture, where the remaining part of 100 is represented by the amide (III) and/or the esters (IV), more preferably the remaining part of 100% is composed of the amide (III) and one or more esters (IV).

The Applicant has in fact found that the addition of oxazoline (V) to the above compounds (III) and/or (IV) unexpectedly imparts an improved solubility of the above compounds (III) and/or (IV) as an improvement has been observed stability of the additive in lubricants and fuels, as well as an improvement in the friction reduction of the additive. See the examples.

Said mixture, if with three components, namely oxazoline, amide and ester, can advantageously be a product of an autocatalytic condensation reaction of a carboxylic acid, preferably a fatty acid (saturated or unsaturated), with a primary amino alcohol wherein preferably at least one of the two reagents is derived from renewable sources.

In particular, the present disclosure provides a mixture of organic compounds deriving from the autocatalytic condensation reaction between a fatty carboxylic acid (saturated or unsaturated), of vegetable or animal origin or a synthetic carboxylic acid (synthetic), preferably derived from materials renewable raw materials, of formula (I) as follows, or its mixtures with fatty acids, of vegetable, animal or synthetic origin (synthetics), also referred to in abbreviated form as CA:

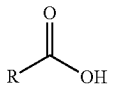

(I)

CA wherein

R is a group selected from a linear or branched alkyl, or linear or branched alkenyl, having a number of carbon atoms comprised between 2 and 40, preferably between 2 and 28, more preferably between 2 and 20;

with an amino alcohol (AO) of formula (II) as follows (II)

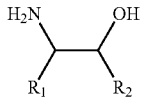

AO wherein R1 and R2 groups, which can be the same or different from each other, are independently selected from hydrogen, a hydroxy methylene group (—$CH_2OH$) and hydrocarbon groups, based on carbon and hydrogen (and free of heteroatoms), linear or branched having formula: $C_nH_{2n+1}$, $C_nH_{2n}$, $C_nH_n$, where "n" is an integer that can vary from 1 to 40, preferably in the range 8-12.

In a preferred form of the disclosure, the acids of formula (I) can be pure or mixed with each other and can be both saturated and unsaturated.

In another preferred embodiment, the group R of the carboxylic acid (I) is an alkyl or alkylene group, with a number of carbon atoms equal to at least 8, preferably at least 12, more preferably at least 16, and preferably with a straight chain.

When component (I) is of vegetable and/or animal origin it generally occurs in the form of a mixture with analogous fatty acids: for example, in the case of oleic acid it will be in a mixture with at least three or four analogous $C_{16}$-$C_{20}$ compounds.

If the carboxylic acid (I) is synthetic, the acid is identified with a certain technical grade, generally at least 95% by weight, as it is mixed with minimum quantities of one or at most two other compounds upper/lower analogs.

In a preferred form of the disclosure, the amino alcohols (II) used are ethanol amine (with $R_1$, $R_2$=H) and amino propandiol (with $R_1$=H, $R_2$=—$CH_2OH$) or its isomer (R1=—$CH_2OH$, $R_2$=H), enantiomerically pure or in racemic form, hereinafter also referred to as APD for simplicity.

As stated above, the mixture of organic compounds object of the present disclosure comprises an amide (AM-AO) of general formula (III), (III)

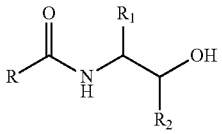

AM-AO and/or one or more esters (E-AO) of general formula (IV)

(IV)

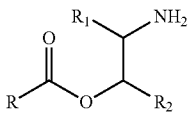

E-AO and an oxazoline (OX-AO) of general formula (V)

(V)

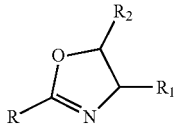

OX-AO wherein R, $R_1$, $R_2$ groups present in the structure of formulas (III), (IV) and (V) have the meaning previously described for formulas I and II.

In a preferred embodiment of the present disclosure, the mixture of organic compounds object of the present disclosure comprises the three compounds indicated above with formula (III), (IV), (V), preferably obtainable from the condensation reaction between the carboxylic acid (I) and the alkanolamine (II) indicated above.

The amide of formula (III) is present in the above mixture of the disclosure at a concentration, expressed as a percentage by weight with respect to the total weight of the mixture, between 1 and 90%, more preferably between 20 and 85%, even more preferably between 30 and 75%.

The carboxylic acid ester, or the mixture of esters, of formula (IV) is present in the above mixture of the disclosure at a concentration, expressed as a percentage by weight with respect to the total weight of the mixture, between 1 and 60%, more preferably between 3 and 30%, even more preferably between 5 and 20%.

The oxazoline of formula (V) is present in the mixture of the disclosure at a concentration, expressed as percentage by weight with respect to the total weight of the mixture, between 9% and 80%, more preferably between 15 and 70%, even more preferably between 20 and 50%.

In a preferred form, the mixture of the present disclosure comprises (% by weight with respect to the total weight of the overall mixture)

between 30% and 75% of an amide (III);

between 5% and 20% of ester or esters (IV)

between 20% and 50% of oxazoline (V).

If the additive of the present disclosure is the product of the condensation reaction, the concentration of one component of the above mixture with respect to the other two components will depend on the operating conditions of the preparation process (time, temperature, solvent, molar ratios, ratio of equivalents between amino alcohol (II) and carboxylic acid (I)), as will be described in detail below.

In a preferred form of the present disclosure, the mixture comprises the following organic compounds:

an amide (III) of specific formula (VI), also indicated with the abbreviation "AM-APD"

(VI)

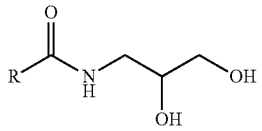

AM-APD and/or an ester (IV) of specific formula (VII), also referred to as "E1-APD" for brevity (first ester)

(VII)

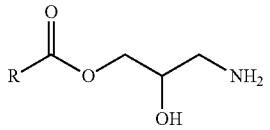

E1-APD and/or an ester (III) of specific formula (VIII), also referred to as "E2-APD" for the sake of brevity (second ester)

(VIII)

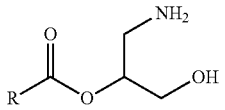

E2-APD and oxazoline (V) of specific formula (IX), also referred to as "OX-APD" for brevity (IX)

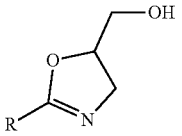

OX-APD wherein R for all the above formulas (from VI to IX) assumes the meaning previously described for formulas I and II, preferably R is a hydrocarbon chain deriving from oleic acid.

In one embodiment, the additive of the present disclosure can be a mixture between oxazoline (IX) and only one of the indicated components of formula (VI), (VII), (VIII), or a mixture of oxazoline (IX) with combinations of components (VI), (VII), (VIII).

In another preferred embodiment the mixture contains all the components (VI), (VII), (VIII), (IX) and is preferably obtainable from the condensation reaction indicated above starting from carboxylic acid (I) and from an amino alcohol (II) in the form of diol, or from an amino propandiol $R_1$=H, $R_2$=—$CH_2OH$).

In another preferred form of the present disclosure the mixture comprises the following organic compounds amide (III) of specific formula (X)

(X)

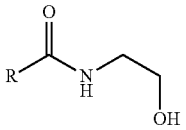

AM-EA and/or ester (III) of specific formula (XI)

(XI)

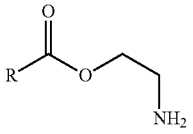

E-EA and oxazoline (V) of specific formula (XII)

(XII)

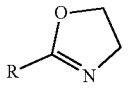

OX-EA wherein R in all the above formulas (from X to XII) takes on the meaning previously described for formulas I and II.

In one embodiment, the additive of the present disclosure can be a mixture obtained from the condensation reaction of carboxylic acid (I) and from ethanol amine as amino alcohol (II).

The Applicant has surprisingly found that the present additive formed by the mixture of compounds of general formula (III), (IV), (V) according to the disclosure, shows the following properties and advantages:

- complete solubility of the mixture object of the present disclosure both in lubricating oil and in fuel: this was unexpected given the presence of amide compounds, generally not very soluble. The lubricants containing the mixture of the disclosure have in fact proved to be clear, without deposits, in particular when containing high concentrations of oxazoline;
- high ability to reduce friction in both lubricant and fuel formulations: this was unexpected since oxazoline as it is does not have friction reducing properties.

In fact, the present additive consisting of the mixture of compounds of general formula (III), (IV), (V) as defined above, unlike the technologies reported in the known art, is able to satisfy all of the following desired properties for a friction reducing additive:

- organic additive (i.e. mixture of organic compounds as defined above) free of metal compounds, sulfur and phosphorus, ideal for lubricant technology of medium (Mid Saps) and low (LOW Saps) content of sulphated ash, phosphorus and sulfur, capable of significantly reducing friction both when used in fuel and lubricant;
- bio-renewable additive since it can be obtained from bio-renewable raw materials such as oleic acid and amino propanediol, but also ethanol amine, which could derive from ammonia and ethylene oxide, with the latter produced by the oxidation of ethylene (bio), obtainable in turn by dehydration of (bio) ethanol.

Other advantages of the mixture of organic compounds object of the present disclosure can be summarized as follows.

A first advantage emerges from the comparison of the friction reduction performances of the mixture of the disclosure with those of compounds of the known art such as for example those reported in US patent U.S. Pat. No. 9,562,207, which claims an organic friction modifier additive, free of metallic elements, formed by a mixture of fatty alkanolamides obtained from alkanolamines containing secondary hydroxyls on the amino-alkyl substituent, (e.g. bis 2-hydroxypropyl amine.

See the comparative examples in which the commercial product Lanxess MLA-3202 was used as the compound of the patent U.S. Pat. No. 9,562,207.

As evidenced by the examples, the mixture of compounds object of the present disclosure confers values of Stribeck coefficient (SFC) to the lubricant always lower with respect to both the lubricant comprising the Lanxess MLA-3202 additive and a further lubricant added with a second commercial product OFr—C called Jeffadd FR-785, an ethoxylated C12-14 alkoxy polyoxypropylene-2-propylamine.

The mixture object of the present disclosure also has the advantage of being able to be used also in fuel, as well as in lubricant, while many of the known additives have indications of use only in lubricants and not in fuels, such as the Lanxess MLA-3202 product described in U.S. Pat. No. 9,562,207.

As mentioned above, the present additive can be obtained by mixing the components previously prepared individually, or more conveniently by means of a condensation reaction between a carboxylic acid (I) and an alkanolamine (II) as defined above.

Therefore, a further object of the present disclosure is the production process of said friction reducing additive formed by the aforementioned mixture of compounds of general formula (III), (IV) and (V), by reaction of fatty acids (I) and alkanolamines (II) as defined above, said process comprising the following step:

(a) conducting a condensation reaction between a fatty acid, or a mixture of fatty acids, of formula (I) as defined above, and an amino alcohol of formula (II) as defined above, in the presence of an organic solvent immiscible in water, for form the product mixture containing the compounds of general formula (III), (IV) and (V) wherein the oxazoline (V) is in an amount greater than 8% by weight.

Advantageously, in order to obtain a mixture separated from the water, which is formed during the condensation reaction, but also separated from the unreacted reagents and the used organic solvent, step (a) is followed by one or more separation steps, which are carried out under conditions such as not to remove from the mixture one or more of the compounds of general formula (III), (IV) and (V).

In particular, after step (a) the following steps are advantageously followed in sequence (b) removing water from the mixture obtained in step (a);

(c) subjecting the mixture obtained in (b) to distillation under vacuum to remove the reaction organic solvent, generally lowering the temperature with respect to steps (a) and (b);

(d) removing the unreacted amino alcohol from the mixture obtained in (c), for example by distillation at a higher vacuum degree than in step (c) without increasing the temperature, or by washing;

where step (d) can optionally be carried out before step (c) if an organic solvent having a boiling point higher than that of the amino alcohol is used.

The above steps (a), (b), (c), (d) of the present process can be carried out consecutively in the same reactor or in separate reactors, preferably in the same reactor.

Steps (a) and (b) can advantageously be carried out simultaneously, operating under the same temperature and pressure conditions.

As an example of a reactor we can cite a CSTR reactor equipped with a line for the vapors and a condenser.

Furthermore, the reactor can be managed both in discontinuous and continuous mode: in the first case, once the reagents have been loaded, the completion of the reaction is expected and the product is recovered from the bottom once the separation operations described above have been carried out.

In the second case, the withdrawal of the reaction products and the feeding of the reagents take place continuously, in order to keep the reaction volume inside the boiler constant.

The condensation step (a) is carried out in the absence of catalyst, at a temperature of at least 100° C., preferably between 100° C.-110° C. and 220° C., more preferably between 150° C.-160° C. and 200° C.

Furthermore, the condensation reaction of step (a) can be carried out at a pressure ranging from 1 absolute bar to 5 absolute bar, preferably between 1 absolute bar and 2 absolute bar, more preferably between 1 and 1.2 absolute bar.

In one embodiment, step (a) is carried out at least at 160° C. and at atmospheric pressure.

The reaction of step (a) is carried out for a time such as to allow the cyclization of the amino alcohol and obtain an oxazoline content higher than 7% by weight in the mixture of reaction products: depending on the working conditions (temperature, pressure, molar/equivalent ratios between the reagents, type of solvent), it can vary from 4 hours to 40 hours, preferably between 4 and 15-24 hours, more preferably between 7 and 10 hours, even if this is not binding for the purposes of present disclosure.

Obviously, all other things being equal, the greater the elapsed reaction time, the greater the oxazoline (V) content in the mixture.

In practice, the reaction of step (a) is considered finished when there is no longer substantial production of water which is the stoichiometric co-product that accompanies the formation of all three compounds (ester, amide, oxazoline) making up the subject mixture of the disclosure.

In step (a), the carboxylic acid (I) can be, as mentioned, saturated or unsaturated.

The preferred saturated carboxylic acids of formula (I) can be selected from capric acid, lauric acid, myristic acid, stearic acid, isostearic acid, arachidic acid, behenic acid and lignoceric acid.

Preferred unsaturated carboxylic acids of formula (I) can be selected from lauroleic acid, myristoleic acid, palmitoleic acid, oleic acid, gadoleic acid, erucic acid, linoleic acid and linolenic acid.

In a preferred form, carboxylic acids (I) of bio-renewable origin, or fatty acids, are used, in particular the most preferred fatty acid is oleic acid of both animal and vegetable origin, optionally in admixture with other carboxylic acids.

Examples of a mixture of oleic acid with other carboxylic acids can be the following three mixtures having a composition divided as follows:

| | Animal origin % weight | Vegetable origin % weight | Technical grade oleic acid % weight |
|---|---|---|---|
| Palmitoleic acid | 1.10% | 0.00% | 0.00% |
| Oleic | 83.00% | 89.90% | 96.60% |
| Linoleic | 8.80% | 6.20% | 1.20% |
| Palmiticus | 3.60% | 2.90% | 0.00% |
| Stearic | 1.50% | 1.00% | 2.20% |
| Dioctyl ester of adipic acid | 0.90% | 0.00% | 0.00% |
| $C_{20}$ mono unsaturated | 1.10% | 0.00% | 0.00% |
| Total | 100.00% | 100.00% | 100.00% |

The preferred amino alcohols of formula (II) to be used in step (a) can be selected from ethanol amine and amino propanediol (specific isomer or mixture of isomers), both of fossil origin and of bio-renewable origin, in the form of a mixture of isomers or as individuals.

In a preferred form, the amino alcohol used is amino propandiol (APD): this product is presented as a viscous compound having a purity higher than 99%; the remaining part (about 1%) is constituted by the respective isomer known with the name of "Serinol".

In step (a), amino alcohol (II) can be used in an amount, expressed as the ratio between the equivalents of amino alcohol (II) and the equivalents of carboxylic acid (I), preferably between 1 and 2, more preferably between 1.05 and 1.4, more preferably between 1.1 and 1.35, even if these values are not binding for the purposes of the present disclosure.

In fact, it is possible to use higher quantities to favor the formation of oxazoline in a short time, even if such conditions are not preferred.

The reaction water-immiscible solvent of step (a) can be selected from those having a boiling point equal to or higher than the reaction or working temperature in the condensation reaction between carboxylic acid (I) and amino alcohol (II). The working temperature is given by the boiling point of the mixture. In any case, the working temperature must be at least the minimum at which the removal of the stoichiometric water resulting from the various condensation reactions takes place.

The reaction water-immiscible organic solvent of step (a) is chemically inert in the condensation reaction and has the function of mixture homogenizing the reaction and homogeneously distributing the heat in the reaction mass. It can preferably be selected from

- aromatic hydrocarbons with a number of carbon atoms ranging from 6 to 16, more preferably selected from toluene, xylenes and tetralin, or Solvesso™;
- aliphatic or cycloaliphatic hydrocarbons with a number of carbon atoms comprised between 7 and 16, more preferably decane or decalin;
- alkyl, aryl-alkyl and aromatic ethers with a number of carbon atoms ranging from 8 to 16, more preferably anisole, ethoxybenzene and diphenyl ether;
- or mixtures of their combinations In a preferred embodiment, the organic solvent used in step (a) is anisole, ethoxybenzene or diphenylether, xylene, n-decane, Solvesso™, or mixtures thereof.

The amount of reaction solvent added in step (a), expressed as a percentage by weight of said solvent with respect to the amount of fed reactants, can preferably be between 10% and 500%, more preferably between 20% and 100%, even more preferably between 25% and 40%.

In another preferred form, the reaction solvent is anisole, added in an amount corresponding to a percentage by weight, between 10% and 90%, preferably between 30% and 70%, calculated with respect to all the components of the mixture of reaction.

The step (b) of removing the stoichiometric reaction water is advantageously carried out simultaneously with the reaction step (a), for example using a reactor with a vapor line that flows into a collection container arranged with a condenser for collection of the heterogeneous mixture $H_2O$-solvent: the latter, generally with a density lower than that of water, will fall back into the reactor ensuring the continuous development of the reaction.

Step (c) of distillation of the reaction solvent from the reaction product generally takes place at lower temperatures than steps (a) and (b), at a temperature between 90° C. and 180° C., preferably between 120° C. and 160° C., and applying vacuum, for example by operating at a pressure between 500 mbar and 10 mbar, preferably between 300 mbar and 20 mbar.

This recovered reaction solvent can then be used again for a subsequent synthesis.

Step (d) of removing the amino alcohol (II) from the reaction product (mixture) contained in the reactor represents a purification step aimed at removing the molar excess of amino alcohol from the mixture: in fact, since amino alcohol is extremely hydrophilic, it is poorly compatible with the final application as an additive in lubricants and fuels.

This step (d) can be carried out in various ways.

For example, in step (d) it is possible to reduce the pressure with respect to step (c) down to a value lower than 20 mbar, preferably lower than 10 mbar, continuing to provide heat.

Alternatively, it is possible to remove amino alcohol (II) from the reaction mixture by washing it with demineralized water, after having diluted the water in a hydrophobic organic solvent.

In this case, the removal of the amino alcohol can be advantageously carried out using heterogeneous low boiling water-solvent mixtures composed of 50% m/m (weight/weight) of water and 50% m/m (weight/weight) of a hydrophobic solvent such as dichloromethane, carbon tetrachloride, diethyl ether, toluene, xylene, cyclohexane or combinations thereof.

The water-solvent washing mixture is added in an amount corresponding to a percentage by weight, between 10% and 90%, preferably between 30% and 70%, calculated with respect to all the components of the mixture (reaction product).

This washing process is repeated for a maximum of three times and, at the end of each washing, the aqueous phase containing the excess amino alcohol is removed by physical separation.

At the end of said washing process, the low boiling hydrophobic solvent is removed by distillation.

In a preferred form, the removal of the excess amino alcohol in step (d) occurs by distillation, exploiting the high boiling point difference existing between amino alcohol and the mixture of organic compounds constituting the reaction product.

At the end of step (d) of purification of the reaction product, a mixture is obtained containing the set of organic compounds having general formulas III, IV, V, with a complete conversion of the amount of carboxylic acid initially present or fed, and with total selectivity towards the 3 types of organic compounds forming the mixture of the disclosure (calculated with respect to the acid).

Obviously, it is possible to drive the reaction towards the various products that make up the mixture of organic compounds by varying the operating conditions (time, temperature), type of solvent and molar ratios of the reactants.

For example, operating at a temperature between 160° C. and 200° C., at an absolute pressure between 1 and 2 bar, with a molar ratio (or equivalent) of amino alcohol/carboxylic acid (AO:CA) between 1.1 and 1.35, using anisole, ethoxybenzene, diphenyl ether as solvents and for a time sufficient to convert the reactants, mixtures are obtained wherein the components of the reaction product (mixture) are in particularly effective quantities for reducing friction:

amide III: between 30% and 75%, esters IV: between 5% and 20%, oxazoline V: between 20% and 50%.

The present process according to the disclosure has a series of advantages including:

- possibility of controlling the composition of the reaction product and therefore the selectivity towards the three types of compounds in the mixture, by suitably acting on the process operating conditions (time, temperature, molar excesses, amount of water removed from equilibrium);
- absence of catalyst, which is instead used to prepare some known compounds (e.g. zinc salts such as zinc acetate), mild operating conditions and total selectivity towards the desired mixture formed by the three types of organic compounds;
- high reagent/solvent ratio, i.e. reduced use of solvent, and use of non-toxic types of solvent.

In particular, the absence of catalyst makes it possible to avoid subjecting the mixture of the three components to a further purification step to remove the catalyst from the mixture of the three components.

According to the present disclosure, a further object also constitutes lubricating compositions (lubricating formulations) comprising

- the friction reducing additive in the form of a mixture as defined above of compounds of general formula (III), (IV) and (V);
- a lubricating base oil, or a mixture of lubricating base oils.

The mixture of the disclosure to be used as a lubricant additive can be a two-component mixture (oxazoline and amide, or oxazoline and ester) or a multi-component mixture as described above, without thereby departing from the scope of the present disclosure.

Base oils are divided into five groups according to their chemical-physical and compositional characteristics.

One way of classification of base oils is that defined by the American Petroleum Institute (API) in the publication "Engine Oil Licensing and Certification System" (API EOLCS, 1507—Industry Services Department, Fourteenth Edition, December 1996, Addendum 1, December 1998).

According to this API classification, the base oils that can be used in the lubricating formulations object of the present disclosure can belong to all aforementioned API Groups, preferably to the API Groups selected from II, III, IV, V and even more preferably to API Groups III, IV and V.

Base oils used in the lubricating compositions object of the present disclosure can then be selected from base oils of mineral, synthetic, vegetable, animal origin and mixtures thereof.

Base oils of mineral origin derive from well-known petroleum refining processes, such as distillation, dewaxing, de-asphalting, dearomatization and hydrogenation.

Base oils of synthetic origin preferably include hydrocarbon oils, as such for example polymerized and hydrogenated terminal or internal olefins; alkylbenzenes; polyphenyls; alkylated diphenyl ethers; the polyalkylene glycols and derivatives, where the terminal hydroxyl groups have been modified for example by esterification or etherification.

Another class of synthetic lubricating oils preferably includes esters of synthetic carboxylic acids or of animal or vegetable derivation with a variety of alcohols or polyols.

A further class of synthetic lubricating oils preferably comprises carbonic acid esters with a variety of alcohols and polyols.

Preferably the base oils of vegetable origin are selected from soybean, palm, castor oil, while the base oils of animal origin are preferably selected from tallow, lard, whale oil.

As already mentioned above, the mixture of organic compounds (formulas III, IV and V) described above turned out to be an additive of base oils capable of significantly reducing the friction that is generated between metal bodies placed in relative motion, increasing the energy efficiency of machinery and in particular of the engines and thus reducing the emission of carbon dioxide.

The lubricating compositions of the present disclosure can contain, in addition to the mixture of the organic compounds of formula III, IV and V of the disclosure, one or more further additives of various kinds.

Such additives can be

- detergent additives, such as for example neutral and overbased calcium and magnesium alkyl benzene sulphonates, detergents based on calcium or magnesium salts of calixarenes,
- viscosity index improver additives,
- dispersant additives,
- antioxidant additives,
- organometallic friction modifier additives,
- anti-wear and extreme pressure additives (EP additives),
- corrosion inhibitors,
- additives to lower the pour point,
- foam inhibitors,
- emulsifiers and others.

The lubricating compositions object of the present disclosure contain as a friction reducing additive the mixture of compounds described above of formula (III), (IV), (V), at a total concentration, expressed as a percentage by weight of said mixture of organic compounds on the total weight of the final lubricating composition, comprised between 0.1 and 50%, preferably between 0.3 and 20%, even more preferably between 0.5 and 5%, advantageously around 1%.

A further object of the present disclosure are lubricating compositions containing the mixture of organic compounds (III), (IV), (V) as described above for applications as high fuel economy automotive lubricants and highly compatible with the after-treatment devices for the exhaust gases of motor vehicles to reduce the emissions of pollutants.

It is known that in order to reduce polluting emissions, motor vehicles must be equipped with exhaust gas treatment systems consisting of anti-particulate filters and/or devices containing catalysts.

The lubricating oil that is drawn in a small part in the combustion chamber contains elements such as sulfur and phosphorus and metals such as calcium, magnesium and zinc which lead to a reduction in the efficiency of these devices.

Vehicles with gasoline-powered engines are equipped with a three-way catalyst based on noble metals for the reduction of CO, unburnt hydrocarbons (HC) and nitrogen oxides ($NO_x$). Such devices can suffer efficiency losses due to the poisoning of the catalysts by elements such as sulfur and phosphorus.

Vehicles with diesel-fueled engines are equipped with catalytic systems for controlling $NO_x$ emissions (LNT or SCR devices) and CO/HC (DOC devices), both of which are sensitive to sulfur and phosphorus.

Diesel engines and more recent gasoline engines with direct injection also require anti-particulate filters which are clogged due to the effect of the inorganic metal components (ashes) deriving from the combustion of the lubricant which in small quantities passes into the combustion chamber. The tendency of the lubricant to form inorganic ash is expressed by the "sulphated ash" parameter.

To ensure the efficiency time of these emission treatment systems, the lubricants must therefore contain low levels of sulphated ash, sulfur and phosphorus (Low/Mid SAPS oils where SAPS means Sulfated Ash, Phosphorus, Sulfur).

In engine oil, phosphorus derives essentially from anti-wear additives (ZDDP or dialkyl dithiophosphates of Zn), sulfur can derive not only from anti-wear, but also from lubricating base oils and detergent compositions, such as those based on calcium sulfonates.

The metals that generate ashes derive mainly from anti-wear additives, from organometallic additives "friction reducers" and from detergent compositions.

The friction reducer additive according to the present disclosure does not contain metals, phosphorus and sulfur, thus ensuring high compatibility with modern exhaust gas treatment devices.

As mentioned above, the mixture of organic compounds of formula III, IV and V can also be added to fuels.

A further object of the present disclosure is formulations of fuels containing the mixture of organic compounds of formula III, IV and V, as described above, for applications such as friction reducers for Otto-cycle internal combustion engines.

The mixture of the disclosure to be used as an additive for fuels can be a two-component mixture (oxazoline and amide, or oxazoline and ester) or a multi-component mixture as described above, without thereby departing from the scope of the present disclosure.

In a preferred form of the present disclosure, the mixture of organic compounds, object of the present disclosure, is used in formulations of fuels and in particular of gasoline, after dilution in solvents or mixtures of solvents to a total concentration, expressed as a percentage by weight of said mixture of organic compounds (III), (IV), (V) between 1% and 75% with respect to the total composition of the solution consisting of the mixture of organic compounds+solvent or mixture of solvents, preferably between 5% and 60%, even more preferably between 10% and 30%.

Said solvents, capable of solubilizing and diluting the mixture of compounds (III), (IV), (V) object of the present disclosure can be preferably selected from:

an alcohol with an acyclic or cyclic alkyl chain, or an alkyl-aryl chain, containing a number of carbon atoms ranging from 1 to 16; more preferably selected from methanol, ethanol, propanol, isopropanol, butanol, cyclohexanol, 2-ethylhexanol, dodecanol, benzyl alcohol;

a polyhydroxy aliphatic hydrocarbon having a number of carbon atoms comprised between 2 and 4; more preferably selected from ethylene glycol, propylene glycol or glycerin;

a di-alkylene glycol or a tri-alkylene glycol wherein the alkylene group contains from 2 a 4 carbon atoms, more preferably selected from diethylene glycol, dipropylene glycol or triethylene glycol;

a mono-alkylene glycol alkyl ether, or a poly-alkylene glycol alkyl ether of formula (XIII).

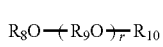

(XIII)

wherein $R_8$ is an alkyl group containing a number of carbon atoms ranging from 1 to 6; $R_9$ is a bivalent group containing carbon and hydrogen with a number of carbon atoms between 2 and 4; $R_{10}$ is hydrogen or an alkyl group with a number of carbon atoms ranging from 1 to 6; r is an integer between 1 and 6; more preferred are the monomethyl ethers, the dimethyl ethers of ethylene glycol, diethylene glycol, triethylene glycol or tetraethylene glycol, and mixtures thereof.

a ketone with alkyl or alkyl-aryl or aromatic groups, each containing a number of carbon atoms ranging from 1 to 10; more preferably selected from acetone, methyl ethyl ketone, methyl isobutyl ketone, cyclohexanone or acetophenone;

an ester of an aliphatic or aromatic carboxylic acid with a number of carbon atoms ranging from 1 to 10, more preferably selected from ethyl acetate and butyl acetate;

an aliphatic, linear or branched, or aromatic hydrocarbon with a number of carbon atoms ranging from 4 to 40;

lubricating base oils;

and mixtures thereof.

The aromatic hydrocarbon solvent is preferably selected from benzene, substituted benzenes and mixtures thereof; more preferably it is selected from toluene, xylene and mixtures thereof.

The aliphatic hydrocarbon solvent is preferably selected from aliphatic hydrocarbons with a number of carbon atoms ranging from 4 to 30 and mixtures thereof.

The lubricating base oils that can be used for the solubilization of the mixture of organic compounds of the present disclosure are those already described above and can belong to all the aforementioned API Groups, preferably to the API Groups selected from I, II, III, IV, V (e.g. polyol ester) and even more preferably to API V Group and in particular those belonging to the class of ester base oils.

A single solubilization solvent can be used in the solubilization process of the mixture of organic compounds (III), (IV), (V) according to the present disclosure.

In a preferred form, a mixture of solubilization solvents composed of one or more types of the above-mentioned solubilization solvents is used.

In a preferred form, the solubilization solvent mixtures of the mixture of the organic compounds (III), (IV), (V) of the present disclosure consist of a mixture selected from a mixture of polyol ester with 2-ethylhexanol;

a mixture of fatty acid esters with 2-ethylhexanol;

a mixture of polyol ester with octanol;

a mixture of fatty acid esters with octanol;

a mixture of linear or branched hydrocarbon compounds of 4 to 30 carbon atoms with 2-ethylhexanol;

a mixture of linear or branched hydrocarbon compounds from 4 to 30 carbon atoms with octanol.

In a further preferred form, the solubilization solvent of the mixture of organic compounds (III), (IV), (V), is a mixture consisting of linear or branched hydrocarbon compounds from 4 to 30 carbon atoms and 2-ethylhexanol containing an amount of alcohol, expressed as a percentage by weight of the mixture of solvents, comprised between 10% and 80%, preferably between 20% and 50%, more preferably between 10% and 20%.

In another embodiment the solubilization solvent of the additive of the present disclosure is composed of a mixture containing from 10% by weight to 50% by weight of $C_8$ alcohols (for example, 2 ethyl-1-hexanol), and from 90% by weight to 50% by weight of ester base oil (for example, polyol ester) or hydrocarbon mixtures with a range of $C_5$-$C_{30}$, preferably $C_5$-$C_{20}$, even more preferably $C_5$-$C_{15}$.

The solutions thus obtained containing the present friction reducer additive are stable over time and can be added to fuels, for example gasoline or diesel, at a concentration, expressed in ppm weight with respect to the total weight of the final fuel composition between 1 and 10000 ppm, preferably between 10 and 1000 ppm, even more preferably between 50 and 800 ppm.

In one embodiment, the concentration of such solutions in the fuel is between 400 and 800 ppm.

The fuels with these additives make it possible to reduce friction in the mechanical parts of the engine by reducing fuel consumption and therefore are advantageous compared to traditional technology fuels.

Consequently, further object of the present disclosure are fuel formulations containing mixtures of organic compounds III, IV and V, capable of increasing the energy efficiency of the engine.

EXAMPLES

The composition of the reaction mixture of the following preparation examples was monitored through the following analytical techniques: FT-IR analysis, HPLC analysis and NMR analysis.

FT-IR Analysis

One of the analytical techniques used for monitoring the progress of the reaction consists in the use of infrared rays (IR) combined with the use of the Fourier transform (FT).

The instrument used (Perkin Elmer Frontier model) therefore has a typical configuration wherein an IR beam source irradiates the sample which conveys the radiation towards a detector for the simultaneous recording of the respective interferograms.

TABLE 1 typical IR absorptions of compounds having formula VI (AM-APD), VII (E1-APD), VIII (E2-APD), IX (OX-APD)

| | Symm. Stretching NH | Asymm. Stretching NH | Stretching C=O | Stretching C=N |
|---|---|---|---|---|
| APD | 3351 | 3292 | | |
| CA (I) | | | 1708 | |
| AM-APD | 3314 | | 1639 | |
| E1-APD + E2-APD | | | 1740 | |
| OX-APD | | | | 1663 |

where R in the formulas VI (AM-APD), VII (E1-APD), VIII (E2-APD), IX (OX-APD) is a hydrocarbon chain deriving from oleic acid $CH_3(CH_2)_7CHCH(CH_2)_7COOH$ (see the preparation examples).

HPLC Analysis

The samples analyzed by HPLC (reagent mix and product mix) were prepared by completely eliminating the reaction solvent and diluting the same sample (1% by weight) in THE. The HPLC system used consists of an HPLC pump, a small oven for thermostating the column, a UV-visible detector for HPLC, an autosampler and a PC equipped with software for the acquisition and processing of chromatographic data.

In particular, the system used is the Agilent 1260 HPLC Infinity II with Chemstation software. The column used is the Agilent PLRP-S 100TO, 4.6×250 mm, 5 μm.

The HPLC method used provides for the following operating conditions:

Pump flow: 0.6 ml/min

Visible UV detector wavelength: 210 nm

Column thermostating temperature: 40° C.

Injection volume: 5 μl

Mobile phases: acetic acid 60 mM (A); acetonitrile (B); THE (C

Mobile phase composition (gradient): 0-20 minutes (A from 35% to 0%; B from 60% to 90%; C from 5% to 10%), 20-40 minutes (A from 0% to 35%; B from 90% to 60%; C from 10% to 5%).

The chromatogram typically contains several peaks whose area is compared with that of standard solutions of known concentration, used to construct the calibration curve, of the analytes object of the quantification.

Table 2 below shows the typical signals used by the Applicant for monitoring the reaction by means of the HPLC technique.

TABLE 2

HPLC typical elution times of compounds having formula VI (AM-APD), VII (E1-APD), VIII (E2-APD), IX (OX-APD)

| | ABS (200 nm) | ABS (220 nm) | ABS (230 nm) |
|---|---|---|---|
| APD | 1.5 min | 1.5 min | 1.5 min |
| CA | 15.1-15.36-17.0 min | 15.1-15.36-17.0 min | 15.1-15.36-17.0 min |
| AM-APD | 14.1 min | 14.1 min | 14.1 min |
| E1-APD + E2-APD | N.D. | N.D. | N.D. |
| OX-APD | 10.4 min | 10.4 min | 10.4 min |

NMR Analysis

By means of 13C-NMR (nuclear magnetic resonance) analysis, on the other hand, the chemical shift of the functional groups characterizing both the reagents and the products covered by this notification is determined and confirmed.

13C-NMR spectra were performed on samples dissolved in $CDCl_3$ using the Varian-500 instrument.

Table 3 reports the chemical shift of the 13C signals used to verify the formation of the compounds once the synthesis process of the examples reported below has been completed according to the present disclosure.

TABLE 3

13C chemical shift typical of compounds havinformula VI (AM-APD), VII (E1-APD), VIII (E2-APD), IX (OX-APD)

| | $^{13}C$ shift (ppm) |
|---|---|
| APD | 44 |
| CA (formula I) | 180 |
| AM-APD | 175 |

TABLE 3-continued

| 13C chemical shift typical of compounds havinformula VI (AM-APD), VII (E1-APD), VIII (E2-APD), IX (OX-APD) | |
|---|---|
| | $^{13}C$ shift (ppm) |
| E1-APD + E2-APD | 174 + 173 |
| OX-APD | 168 |

As shown in tables 1, 2, 3 each of the analytical techniques such as IR, HPLC and NMR, is selective for the detection of some signals typical of the products having structure VI, VII, VIII and IX contained in the mixture obtained in the preparation examples according to the process object of the present disclosure.

A series of properties have also been evaluated by subjecting lubricants and/or fuels, containing the mixture according to the present disclosure, to a series of tribological laboratory tests, and stability tests as described below.

HERR Tribological Test (Applied to Gasoline)

This HERR test, usually used for the "lubricity" of diesel oils, measures the amplitude of wear and calculates the respective wear index (μm): the lower this value, the more optimal the fuel behavior is considered.

The test is conducted in accordance with the ISO 12156-1 standard adapted for gasoline, using the PCS Instrument kit called "HERR Gasoline Conversion Kit" (which intervenes in limiting the gasoline losses, during the test, due to the extreme volatility of the gasoline itself).

The HERR test is characterized by the following steps:

positioning of the tested fluid on the test plate;

placing a steel ball on the test plate and applying horizontal motion and loading on the steel ball (see FIG. 6 which illustrates the typical couplings of the HERR test; where in the aforementioned FIG. 6: "load"=load; "stroke"=stroke; "plate"=plate; "fuel"=fuel; "mounting"=mounting; "dimension of the wear scar"=amplitude of wear).

Low wear values indicate an optimal behavior of the fuel in terms of "lubricity" (lubricating power exerted by the fuel).

SRV Tribological Test (Applied to Lubricants Only)

Couplings similar to the HERR test are used but more severe test conditions (operating conditions foreseen by the internally developed method):

Load: 75-200 N

Frequency: 25-50 Hz

Stroke: 3 mm

Time: 2 h

At the end of the test, as an instrumental response, a coefficient of friction (COF, dimensionless value –The COF is given by the ratio $F_N/F_F$, where $F_N$=load (N) applied to the sphere; $F_F$=lateral friction generated by the rubbing between the surfaces following horizontal oscillatory motion) and the wear of the sphere is measured by microscopy (mm).

Also in this case, low COF and wear values indicate optimal behavior of the lubricant.

MTM Tribological Test (Applied to Lubricants Only)

MTM equipment allows you to measure COF in any sliding/rolling ratio up to 100% pure rolling.

These characteristics are obtained from the coupling formed between a steel ball loaded against a steel disc as illustrated in FIG. 7.

In such a coupling, contact pressures and cutting velocities can reach high values very similar to those found, for example, in gears, rolling bearings and cams typical of an internal combustion engine (ICE).

All the MTM tests reported in the examples were performed at three different temperatures (45° C., 120° C., 150° C.) maintaining a load of 30N and a sliding/rolling ratio of 50%.

This test can provide the possibility of qualitatively predicting the Fuel Economy of automotive lubricants by reconstructing the Stribeck curve (which allows to obtain the COF as a function of the sliding velocity generated between the contact surfaces) and to calculate the Stribeck coefficient of friction (SFC) which provides an indication of the amount of energy absorbed.

In this application, the Stribeck curve (schematically illustrated in FIG. 8) was constructed for each tested composition starting from relatively high velocity values (2 m/s, starting point of the curves of the graphs in FIGS. 2-4), up to, step by step, at very low values, wherein the speed tends to practically zero (0.004 m/s), in the three different lubrication regimes described below.

In more general terms, the COF trend can be investigated in the three different lubrication regimes (hydrodynamic, mixed and boundary) identified by the thickness of the relative "tribo film", understood as the lubricant film containing the friction reducing additives, which is generated between the surfaces in contact and in relative motion.

Said additives are in fact able to chemically react with the contact surface causing a decrease in the coefficient of friction.

The above three lubrication regimes are defined by a parameter A obtained from the ratio between the thickness of the oil film interposed between the surfaces in contact and their mean square roughness (square root of the sum of the squares of the roughness of the two surfaces):

$$A = \text{film thickness/mean square roughness}$$

The "hydrodynamic" regime, schematically illustrated below in the figure, occurs when the lubricant film (intermediate layer in the figure) is thick enough to completely separate the two surfaces (opposite outer layers in the figure below), avoiding contact between the two bodies: in this situation the thickness of the film is therefore greater than the roughness of the surfaces, with parameter values A between 5 and 100.

In the hydrodynamic regime, the low values of the coefficient of friction (COF) are given by the rheological properties of the lubricant such as, for example, high viscosity indexes and low HTHS viscosity values (high temperature high shear rate), measure of the apparent viscosity of a multi-grade lubricating oil.

Such measurements are carried out at high temperatures (150° C.) and at high shear rates ($10^6$ $s^{-1}$).

The "mixed" regime occurs when the surface roughness between the two bodies in relative motion (indicated by the arrows with opposite direction in the figure below), are quite close together, as shown in the figure below. This situation, typical of couplings generated using gears and roller/ball bearings, is characterized by a parameter value A between 2 and 5.

The boundary regime, identified by relative low velocities, is the situation wherein the lower thickness of tribo film occurs between the metal surfaces (indicated in the figure below by the arrows with opposite direction), with a consequent increase in the COF.

In the boundary regime, the roughness and composition of the surfaces are the main causes of friction, while the viscosity of the lubricant has a minor influence on the friction behavior.

The boundary regime (values of A less than 1) is characterized by a very high load (pressure) in relation to the sliding velocities present between the surfaces.

The evaluation of the Stribeck curve is performed considering not only the trend (FIGS. 2, 3, 4) obtained, but also calculating the area under the same curve using the trapezoid method according to a methodology described in M. Lattuada, M. Manni "*A new methodology for the experimental evaluation of organic antifriction additives*"—$10^{th}$ INTERNATIONAL SYMPOSIUM ON FUELS AND LUBRICANTS, incorporated herein in full by reference.

The result of this integral is the Stribeck coefficient of friction (SFC): low SFC values correspond to excellent Fuel Economy values, thanks to the lubricant's ability to reduce friction between the various couplings present in the engine and in the transmission.

Stability Tests

The stability tests were conducted from a qualitative point of view, visually assessing the presence (turbidity) or absence of deposits (clarity) in the lubricant formulation samples, for a period of two weeks (FIG. 1).

The absence of deposits indicates the complete solubility of the additive in the lubricating oil.

Examples 1-10 of Additive Preparation

All the examples of preparation 1-10 of mixtures containing organic compounds having general formula (VI), (VII), (VIII), (IX) were carried out using a reactor equipped with a vapor line to remove the stoichiometric $H_2O$ of reaction.

The vapor line flows into a second collection container prepared with a condenser for collecting the heterogeneous mixture $H_2O$-solvent: the latter, thanks to a lower density than that of $H_2O$, falls back into the reactor tank (boiler) ensuring the continuous development of the reaction.

Once the reaction is over, the solvent is removed and recovered for the subsequent synthesis.

The final phase is finishing and is aimed at the simple removal, from the reaction product, of the molar excess of amino alcohol, e.g. amino propanediol.

All the experiments reported below were carried out in the following range of operating conditions:

1) temperature between 110° C. and 220° C., preferably 150-200° C.;
2) reaction time comprised between 5 and 24 hours, preferably 7 and 10 hours;
3) operating pressure between 1-2 absolute bar, preferably 1-1.2 absolute bar.

Example 1: PC01 Mixture Synthesis

In a reactor (vol.=500 mL) equipped with vapor line and condenser are respectively added:

oleic acid technical grade (90 g; 0.33 mol),
amino propanediol (40 g, 0.43 mol) and
Xylene (160 g) as a solvent.

The operating pressure is atmospheric.

The reaction mixture is heated up to the reflux temperature of the solvent (about 160° C.) for about 40 hours, monitoring the amount of $H_2O$ (6.5 g) formed and continuously removed from the reaction environment.

Once the reaction is over, the solvent is removed under vacuum, obtaining about g of solid product at room temperature.

The PC01 mixture thus obtained and that obtained following aqueous washing (APD removal), were then characterized with the common analytical techniques such as IR, HPLC and NMR as reported in the tables 1, 2, 3.

Product selectivities (AM-APD, E1-APD, E2-APD, Ox-APD) are shown in table 4.

Example 2: PC02 Mixture Synthesis

In a reactor (vol.=250 mL) equipped with vapor line and condenser are respectively added:

oleic acid technical grade (45 g; 0.17 mol),
amino propandiol (20 g, 0.21 mol) and
ethoxybenzene (75 g) as a solvent.

The operating pressure is atmospheric.

The reaction is heated up to the reflux temperature of the solvent (about 175° C.) for about 30 hours, monitoring the amount of $H_2O$ (4 g) formed and continuously removed from the reaction environment.

Once the condensation reaction has ended with the removal of the reaction water, the solvent is removed under vacuum, obtaining about 60 g of solid product at room temperature.

The PC02 mixture thus obtained and that obtained following aqueous washing (APD removal), were then characterized with the common analytical techniques such as IR, HPLC and NMR, as reported in the tables 1, 2, 3.

Product selectivities (AM-APD, E1-APD, E2-APD, Ox-APD) are shown in table 4.

Example 3: PC03 Mixture Synthesis

In a reactor (vol.=250 mL) equipped with a vapor line condenser, the following are respectively added:

oleic acid technical grade (45 g; 0.17 mol),
amino propandiol (20 g, 0.21 mol) and
n-decane (75 g) as a solvent.

The operating pressure is atmospheric.

The reaction is heated up to the reflux temperature of the solvent (about 185° C.) for about 30 hours, monitoring the amount of $H_2O$ (4.1 g) formed and continuously removed from the reaction environment.

Once the reaction is over, the solvent is removed under vacuum, obtaining about 60 g of solid product at room temperature.

The PC03 mixture thus obtained, and that obtained following aqueous washing (APD removal), were then characterized with the common analytical techniques such as IR, HPLC and NMR, as reported in the tables 1, 2, 3.

Product selectivities (AM-APD, E1-APD, E2-APD, Ox-APD) are shown in table 4.

Example 4: PC04 Mixture Synthesis

In a reactor (vol.=250 mL) equipped with vapor line and condenser are respectively added:

oleic acid technical grade (52 g; 0.19 mol),
amino propanediol (20 g, 0.21 mol) and
Solvesso™ 150 (90 g) as a solvent (typical industrial solvent manufactured by Exxon Mobil).

The operating pressure is atmospheric.

The reaction is heated up to the reflux temperature of the solvent (about 195° C.) for about 10 hours, monitoring the amount of $H_2O$ (5.4 g) formed and continuously removed from the reaction environment.

Once the reaction is over, the solvent is removed under vacuum, obtaining about 66 g of fluid product at room temperature, thanks to the possible presence of non-removed solvent.

The PC04 mixture thus obtained and also the one following the stripping of the residual APD, were then characterized with the common analytical techniques such as IR, HPLC and NMR, as reported in the tables 1, 2, 3.

Product selectivities (AM-APD, E1-APD, E2-APD, Ox-APD) are shown in table 4.

Example 5: PC05 Mixture Synthesis

In a reactor (vol.=500 ml) equipped with vapor line and condenser are respectively added:

oleic acid technical grade (110 g; 0.41 mol),
amino propandiol (40 g, 0.43 mol) and
n-decane (75 g) as solvent.

The operating pressure is atmospheric.

The reaction is heated up to the reflux temperature of the solvent (about 185° C.) for about 16 hours, monitoring the amount of $H_2O$ (7.8 g) formed and continuously removed from the reaction environment.

Once the reaction is over, the solvent is removed under vacuum, obtaining about 140 g of solid product at room temperature.

The PC05 mixture thus obtained, and that deriving from the stripping of the residual APD, were then characterized with the common analytical techniques such as IR, HPLC and NMR, as reported in the tables 1, 2, 3.

Product selectivities (AM-APD, E1-APD, E2-APD, Ox-APD) are shown in table 4.

Example 6: PC06 Mixture Synthesis

In a reactor (vol.=500 mL) equipped with vapor line and condenser are respectively added:

oleic acid technical grade (110 g; 0.41 mol),
amino propanediol (40 g, 0.43 mol) e
n-decane (75 g) as a solvent.

The operating pressure is atmospheric.

The reaction is heated up to a temperature of 150° C. for 8 hours and subsequently at 180° C. for a further 10 hours, monitoring the amount of $H_2O$ (7.5 g) formed and continuously removed from the reaction environment.

Once the reaction is over, after stripping the solvent approximately 140 g of product are obtained and subsequently the residual APD is removed under vacuum.

The mixture obtained after removing the solvent and the final one after stripping the residual APD were then characterized with the common analytical techniques such as IR, HPLC and NMR, as reported in the tables 1, 2, 3.

Product selectivities (AM-APD, E1-APD, E2-APD, Ox-APD) are shown in table 4.

Example 7 (Comparative): PC07 Mixture Synthesis (No Solvent and No Oxazoline)

In a reactor (vol.=250 mL) equipped with vapor line and condenser are respectively added:

oleic acid technical grade (52 g; 0.19 mol),
amino propanediol (20 g, 0.21 mol).

The reaction mixture is heated up to a temperature of 110° C. under reduced pressure (100 mbar) for 3 hours then at 160° C. and 1 mbar for a further 18 hours, and subsequently at 180° C. for a further 16 hours.

Once the reaction is over, the resulting product is quantified, having a mass of about 61 g.

The PC07 mixture thus obtained and that deriving from the stripping of the residual APD, were then characterized with the common analytical techniques such as IR, HPLC and NMR, as reported in the tables 1, 2, 3.

Product selectivities (AM-APD, E1-APD, E2-APD, Ox-APD) are shown in table 4.

Example 8: PC08 Mixture Synthesis

In a reactor (vol.=500 mL) equipped with vapor line and condenser are respectively added:

oleic acid technical grade (90 g; 0.33 mol),
amino propanediol (40 g, 0.43 mol) and
n-decane (85 g) as a solvent.

The operating pressure is atmospheric.

The reaction is heated up to a temperature of 185° C. for 55 hours, monitoring the amount of $H_2O$ (10 g) formed and continuously removed from the reaction environment.

Once the reaction is over, the solvent is removed under vacuum, obtaining about 119 g of liquid product at room temperature.

The PC08 mixture thus obtained and that deriving from the stripping of the residual APD, were then characterized with the common analytical techniques such as IR, HPLC and NMR, as reported in the tables 1, 2, 3.

Product selectivities (AM-APD, E1-APD, E2-APD, Ox-APD) are shown in table 4.

Example 9: PC12 Mixture Synthesis

In a reactor (vol.=500 mL) equipped with vapor line and condenser are respectively added:

oleic acid of vegetable origin, the composition of which is shown in the table in the description (90 g; 0.34 mol),
amino propandiol (40 g, 0.43 mol) and
n-decane (85 g) as a solvent.

The operating pressure is atmospheric.

The reaction is heated up to a temperature of 185° C. for 25 hours, monitoring the amount of $H_2O$ (8 g) formed and continuously removed from the reaction environment.

Once the reaction is over, the solvent is removed under vacuum, obtaining about 120 g of solid product at room temperature.

The PC12 mixture thus obtained and that deriving from the stripping of the residual APD were then characterized with the common analytical techniques such as IR, HPLC and NMR, as reported in the tables 1, 2, 3.

Product selectivities (AM-APD, E1-APD, E2-APD, Ox-APD) are shown in table 4.

Example 10: PC13 Mixture Synthesis

In a reactor (vol.=500 mL) equipped with vapor line and condenser are respectively added:

oleic acid of animal origin, the composition of which is shown in the table in the description (145 g; 0.54 mol),
amino propanediol (56 g, 0.60 mol) and
anisole (88 g; 0.81 mol) as a solvent.

The operating pressure is atmospheric.

The reaction is heated up to a temperature of 170° C. for 10 hours, monitoring the amount of $H_2O$ (13 g) formed and continuously removed from the reaction environment.

Once the reaction is over, the solvent is removed under vacuum, obtaining about 187 g of product.

The PC13 mixture thus obtained and that deriving from the subsequent stripping of the residual APD, were then characterized with the common analytical techniques such as IR, HPLC and NMR, as reported in the tables 1, 2, 3.

Product selectivities (AM-APD, E1-APD, E2-APD, Ox-APD) are shown in table 4.

From the data coming from the analytical techniques previously described, it is possible to quantify the reaction selectivities and the residual concentration of the molar excess of APD (table 4).

In all the examples the conversion of oleic acid is total, as determined by IR analysis and therefore the yield of the products of the mixture, calculated with respect to the oleic acid, coincides with the selectivity.

TABLE 4

Reaction Selectivity and Residual APD, Examples 1-10

| Example | # Mixture | Selectivity AM-APD + E1-APD + E2-APD % weight | Selectivity OX-APD % weight | Residual APD % weight |
|---|---|---|---|---|
| 1 | PC01 | 93 | 7 | 7.5 |
| 2 | PC02 | 74 | 26 | 6.1 |
| 3 | PC03 | 69 | 31 | 6.0 |
| 4 | PC04 | 41 | 59 | 2.8 |
| 5 | PC05 | 93 | 7 | 1.3 |
| 6 | PC06 | 97 | 3 | 1.3 |
| 7 (comp.) | PC07 | NA | — | 3.3 |
| 8 | PC08 | 35 | 65 | 7.5 |
| 9 | PC12 | 76 | 24 | 6.8 |
| 10 | PC13 | 72 | 28 | 3.0 |

The data reported in table 4 relate to the analysis of the mixture after removal of the solvent (and before the removal of the residual APD) from which the following parameters were determined:

1) Selectivity (wt %) to reaction products (AM-APD, E1-APD, E2-APD, Ox-APD) by NMR analysis;

2) Residual APD concentration (wt %) by HPLC analysis.

The subsequent purification of the mixture by aqueous washing (examples 1, 2 and 3) or by low pressure stripping (examples 4 to 10) leads in all cases to a residual APD concentration lower than 1% by weight (measurable with HPLC).

The results reported in table 4 show that the process allows to direct the selectivity towards the various products that make up the mixture of organic compounds by varying the operating conditions (time, temperature), type of solvent and molar ratios of the reactants.

Furthermore, the data of example 7 show that, by operating outside the process conditions according to the disclosure, there is no formation of oxazoline in the condensation reaction.

Examples 11-13 (Comparative) and 14-23: Preparation of Formulations, Stability Tests and Tribological Tests All the product mixtures obtained in examples 1 to 10 were subsequently used as FRs additives in a typical "PCMO" (passenger car motor oil) formulation SAE OW-20 grade.

To compare all the additives prepared in examples 1-10, the preparation of the lubricant formulation took place with the method described below.

A "master mix" (MM) consisting of a lubricant, a viscosity modifier and a PPD (Pour Point Depressant), is added with a friction reducer FR as a final additive at a concentration equal to 1% by weight with respect to the total mixture.

The lubricant of the MM is a mixture of a Group III base oil and a Part Package additive package, PP, which contains all the additives generally found in lubricants (dispersant, detergent, antioxidant, antiwear) except the FR friction reducer.

The MM therefore contains altogether (by weight):

from 83% to 85% of a Group III base oil (API classification) (kinematic viscosity=4 cSt at 100° C.);

from 3% to 4% of a Viscosity Modifier VM (styrene-butadiene copolymer in Group III base oil);

from 0.1% to 0.5% PPD (Pour Point Depressant) consisting of alkyl polymethacrylate in Group I base oil;

from 10.5% to 11.5% Part Package.

In this way, the final formulations of the lubricating compositions reported in the following table 5 (examples 11 to 23) are obtained, used in the qualitative stability tests (Yes/No) and in the tribological tests reported below.

TABLE 5 lubricants used for stability tests and tribological tests

| # Example | # Lubricant (base oil + PP) | FR used | Final formulation | % OX-APD in the additive | # Lubricant stability (Y/N) |
|---|---|---|---|---|---|
| 11 (comp.) | Mix 35/19 | — | MM | | Y |
| 12 (comp.) | Mix 36/19 | OFr-C | MM-OFr-C | | Y |
| 13 (comp.) | Mix 10/19 | MLA-3202 | MM-MLA-3202 | | Y |
| 14 | Mix 38/19 | PC01 | MM-PC01 | 7 | N |
| 15 | Mix 39/19 | PC02 | MM-PC02 | 26 | Y |
| 16 | Mix 40/19 | PC03 | MM-PC03 | 31 | Y |
| 17 | Mix 41/19 | PC04 | MM-PC04 | 59 | Y |
| 18 | Mix 42/19 | PC05 | MM-PC05 | 7 | N |
| 19 | Mix 43/19 | PC06 | MM-PC06 | 3 | N |
| 20 (comp.) | Mix 44/19 | PC07 | MM-PC07 | — | N |
| 21 | Mix 45/19 | PC08 | MM-PC08 | 65 | Y |
| 22 | Mix 53/19 | PC12 | MM-PC12 | 24 | Y |
| 23 | Mix 55/19 | PC13 | MM-PC13 | 28 | Y |

All lubricants listed in the table have the same viscosity range because they are formulated to comply with a "SAE OW-20" grade (whose property value ranges are listed in the SAE J300 table).

The first three lubricants (shown in table 5 (Mix 35/19, Mix 36/19, Mix 10/19) are used as a reference, i.e. as comparative examples not forming part of the disclosure.

Mix 35/19 (comparative example 11) does not contain additive friction reducer, while Mix 36/19 and Mix 10/19 (comparative examples 12 and 13) contain commercial organic friction reducers named, respectively, in (Mix 36/19): OFr—C(Jeffadd FR-785) which is made up of given compounds from the reaction between alkyl polyetheramine and ethylene oxide (ethoxylated $C_{12}$-$C_{14}$ alkoxy polyoxypropylene-2-propylamine);

in (Mix 10/19): MLA-3202 synthesized by condensation of carboxylic acids and non-primary alkanolamines (amidation product of esters of $C_{16}$ and $C_{18}$ fatty acids and of $C_{18}$ unsaturated fatty acids with 1,1'-amino-dipropan-2-ol; the MLA-3202 Safety Product Data Sheet provides a CAS No. 1454803-04-3 from which it can be traced back to the friction reducing additive as defined) which is described in the patent U.S. Pat. No. 9,562,207.

Both of these latter commercial products are distinguished from the mixture according to the present disclosure in that they are in linear form and do not present cyclic compounds of the oxazolinic type.

From a qualitative point of view, the results of the stability tests, (time span equal to two weeks), can be better understood by observing the images shown in FIG. 1, representative of reference blank (example 11; Mix 35/19-case a) of FIG. 1);

all stable lubricating formulations: FIG. 1 shows only the sample of example 18; Mix 39/19-PC02-Y-case b) as a representative visual example also of the other stable lubricant formulations Y of table 5;

all formulations that have not passed the stability test: in FIG. 1 only the sample of example 21 is shown; Mix 42/19-PC05-N-case c), as a representative visual example of the other non-stable lubricant formulations N of table 5.

The stability tests of the lubricants of table 5 have allowed to demonstrate that the stability of the formulation of the present disclosure is strongly dependent on the presence (comparative example 20) and on the concentration of the oxazolinic compound "OX-APD": in fact it appears that high concentrations of "OX-APD" in the mixture forming the reducing additive allow to obtain lubricating formulations of lasting stability over time.

Examples 23-35: MTM Test and Calculation of the Stribeck Coefficients (SFC) at Three Different Temperatures All the lubricants listed in table 5 were subjected to MTM tribological tests (FIGS. 2, 3, 4) according to the methods described above.

As can be seen from FIGS. 2, 3, 4, the differences between the trends of the reference lubricant (Mix 35/19) and of the lubricants with additives are minimal at low temperatures (45° C.) and high at high temperatures (120° C., 150° C.).

This aspect is typical of organic friction reducers which tend to be activated, decreasing the coefficient of friction (COF), at medium-high temperatures (about 80° C.).

To better understand which additive gave the best contribution, the Stribeck coefficient (SFC) for each curve for all three temperature ranges (45° C., 120° C., 150° C.) was calculated with the trapezoidal method (see above).

The results obtained from this processing with respect to the compositions of examples 23 to 35 are shown in table 6.

TABLE 6

Stribeck coefficients obtained in the three different temperatures

| # Example | # Lubricant | SFC-45° C. | SFC-120° C. | SFC-150° C. | Stability |
|---|---|---|---|---|---|
| 23 Comp. | Mix 35/19 | 0.137 | 0.213 | 0.284 | Y |
| 24 Comp. | Mix 36/19-OFr-C | 0.139 | 0.129 | 0.131 | Y |
| 25 Comp. | Mix 10/19-MLA-3202 | 0.113 | 0.135 | 0.136 | Y |
| 26 | Mix 38/19-PC01 | 0.144 | 0.140 | 0.139 | N |
| 27 | Mix 39/19-PC02 | 0.141 | 0.127 | 0.125 | Y |
| 28 | Mix 40/19-PC03 | 0.140 | 0.125 | 0.124 | Y |
| 29 | Mix 41/19-PC04 | 0.150 | 0.141 | 0.145 | Y |
| 30 | Mix 42/19-PC05 | 0.142 | 0.130 | 0.126 | N |
| 31 | Mix 43/19-PC06 | 0.129 | 0.129 | 0.128 | N |
| 32 | Mix 44/19-PC07 | 0.139 | 0.129 | 0.126 | N |
| 33 | Mix 45/19-PC08 | 0.148 | 0.139 | 0.140 | Y |
| 34 | Mix 53/19-PC12 | 0.141 | 0.127 | 0.125 | Y |
| 35 | Mix 55/19-PC13 | 0.140 | 0.125 | 0.124 | Y |

It can be seen from table 6 that Mix 39/19 with PC02 (example 27) and Mix 40/19 with PC03 (example 28), are characterized by low values of "SFC" compared to the reference lubricant Mix 35/19 (example 23 comparative).

It should be noted that Mix 39/19 with PC02 and Mix 40/19 with PC03 have also proved to be deposit-free lubricants as they are clear, similar to MIX 35/19 shown in FIG. 1, and stable (see table 5).

In fact, all the lubricants indicated as stable turned out to be visually identical to Mix 35/19 and Mix 39/19-PC02 (i.e. clear or substantially clear as shown in FIG. 1), while all the lubricants indicated as unstable were visually identical to Mix 42/19-PC05 (example 30), i.e. with deposits and turbidity as indicated in FIG. 1.

The same result of both stability and by SFC was also observed on lubricants additives with the friction reducing additive of the disclosure obtained from commercially available carboxylic acids of vegetable and animal origin (example 34: Mix 53/19 and example 35: Mix 55/19)

In practice, considering the stable compositions of table 6, it can be noted that the SFC values obtained in tests 26 to 35 are overall lower than the comparatives, i.e. among tests 26 to 35 there are some that are much lower compared to those of lubricants with additives with commercial OFRs. This is more evident at high temperatures, also because the temperature of 45° C. is a temperature to be considered "cold" wherein the additive is less active.

The results reported in an underlined font are to be considered lower (better) than the comparatives.

Examples 36-47: SRV Test

Further in-depth tribological tests were carried out on the lubricants listed in table 5 using the "SRV" equipment (see characterization above).

The instrument used in this test is usually more sensitive to the presence of organometallic "anti-friction" but is however also used for "no harm" tests wherein a lubricant with additives is compared with a reference "blank" (Mix 35/19).

The results of the SRV test are shown in table 7.

TABLE 7 values of COF and wear from SRV test

| # Example | # Lubricant | Ball wear (mm) | COF | Stability |
|---|---|---|---|---|
| 36 Comparative | Mix 35/19 | 0.590 | 0.123 | Y |
| 37 Comparative | Mix 36/19-OFr-C | 0.580 | 0.130 | Y |
| 38 | Mix 38/19-PC01 | 0.527 | 0.115 | N |
| 39 | Mix 39/19-PC02 | 0.582 | 0.110 | Y |
| 40 | Mix 40/19-PC03 | 0.562 | 0.113 | Y |
| 41 | Mix 41/19-PC04 | 0.573 | 0.113 | Y |
| 42 | Mix 42/19-PC05 | 0.550 | 0.118 | N |
| 43 | Mix 43/19-PC06 | 0.537 | 0.118 | N |
| 44 (comp.) | Mix 44/19-PC07 | 0.537 | 0.110 | N |
| 45 | Mix 45/19-PC08 | 0.553 | 0.115 | Y |
| 46 | Mix 53/19-PC12 | 0.511 | 0.115 | Y |
| 47 | Mix 55/19-PC13 | 0.522 | 0.118 | Y |

The trends of the SRV tests shown in FIG. 5 and the relative numerical values shown in table 7 show how the lubricants added with the mixture object of the present disclosure give COF values slightly lower than that of the reference "blank" (Mix 35/19).

Also for the SRV tests the best results, i.e. the lowest values of COF (lighter internal column) and of wear (darker external column), were obtained with the same series of lubricating compositions according to the disclosure (Mix 39/19, Mix 40/19, Mix 53/19, Mix 55/19 with COF values underlined in table 7) characterized by low SFC values in the MTM test (see table 6).

Examples 48-54: HERR Test on Hydrocarbons Added with COF Reducer

Further investigations were carried out in other hydrocarbon fluids (fuels), such as for example gasolines, with the addition of PC02, PC12 and PC13 mixtures which have proved to be particularly advantageous in lubricants.

In particular, the aforementioned "COF reducer" additives were suitably solubilized and added to an "Eni regular RON 95" gasoline on which the respective HERR tribological test was then carried out.

The solubilization was obtained using a solvent composed of a mixture containing from 10% by weight to 50% by weight of $C_8$ alcohols (for example, 2 ethyl-1-hexanol) and from 90% by weight to 50% by weight of base ester (for example, polyol ester) or hydrocarbon mixtures with a range of $C_5$-$C_{30}$, preferably $C_5$-$C_{20}$, even more preferably $C_5$-$C_{15}$.

The concentration of PC02, PC12 and PC13 in the solvent is 10% by weight or 20%.

The fluid thus obtained was added at a concentration of both 800 ppm weight (examples from 50 to 52) and 400 ppm weight (examples 53 and 54) to a regular gasoline without additives.

The HERR results from this trial are shown in table 8 below.

TABLE 8

HFRR test outcome examples 48 to 54

| Example | % additive in solution | ppm additive sol. in gasoline | HFRR test fluid | Wear (μm) |
|---|---|---|---|---|
| 48 comp. | — | | gasoline tq | 878 |
| 49 Comp. | — | | gasoline + solubilization mixture | 600 |
| 50 | 10 | 800 | gasoline + PC02 in mixture | 340 |
| 51 | 10 | 800 | gasoline + PC12 in mixture | 260 |
| 52 | 10 | 800 | gasoline + PC13 in mixture | 270 |
| 53 | 20 | 400 | gasoline + PC12 in mixture | 250 |
| 54 | 20 | 400 | gasoline + PC13 in mixture | 310 |

As shown in the table, all the additives PC02, PC12 and PC13 allow to considerably lower the wear diameter compared to both gasoline without additives (example 48) and compared to gasoline with additives only with the mixture of solvents.

This last test was performed to evaluate the impact in terms of wear and COF that the mixture used to solubilize the friction reducer additive (mixture of compounds) of the present disclosure has on gasoline (example 49).

Particularly effective is the additive, at different ppm, carried out with both PC12 and PC13, i.e. the mixture of organic compounds obtained from raw materials, in particular carboxylic acids, both of vegetable origin (PC12, example 9) and of animal origin (PC13, example 10).

The Applicant has therefore found that the mixtures of organic compounds "PC02", "PC12" and "PC13", which are the same mixtures that in the previous tribological tests (MTM, SRV) in lubricating oil gave the best results, can be used also effectively in fuels and in particular in gasoline.

This last result together with those previously described therefore allows the Applicant to demonstrate how the mixture object of the present disclosure is able to reduce friction both if used in a lubricant and in a fuel.

It is important to remember that the syntheses reported in examples 1 to 8 were carried out using technical grade oleic acid, while the syntheses of examples 9 and 10 saw the use of mixtures of commercial acids both of vegetable origin (PC12) and of animal origin (PC13) with typical composition as reported in the table in the description.

Example 55 (Comparative): Lubricant Formulation Substantially Containing Only Amide and Relative Stability Test To carry out this experimental test, a sample of amide of formula VI (AM-APD) with purity higher than 98% was prepared.

The procedure for obtaining it consists in washing the PC02 sample (example 2) with petroleum ether.

This method allows the separation of the amide (insoluble in petroleum ether) from other components of the mixture of Example 2.

The product thus obtained is mixed with the mother mixture (MM), as in examples 23-35, to obtain the formulation indicated herein as MIX 56/19.

The formulation containing only the amide of formula VI of Example 2 in MIX 56/19 was unstable since after less than one day the formation of a precipitate was observed which indicates the poor solubility of the amide in the lubricating composition, presumably due to strong interaction with itself via hydrogen bond.

From the comparison of comparative example 55 with the examples according to the disclosure of table 5-7, it appears that the addition of oxazoline (V), (IX) to the ester compounds (IV), (VII), (VIII) and amides (III), (VI) has an unexpected and synergistic improvement effect in terms of friction reduction, since the MIX 41/19 and MIX 45/19 which contain the greatest quantities of oxazoline (around 59-65%) show lower friction reduction properties compared to the mixtures MIX 39/19, MIX 40/19, MIX 53/19 and MIX 55/19 which contain lower quantities of oxazoline (around 25-31%).

Without wishing to bind to any theory, it could also be deduced from this that oxazoline by itself does not have high friction reduction properties.

Furthermore, again from the comparison of the comparative example 55 with the examples of table 5-7, it can be observed that the use of oxazoline in quantities higher than 7% by weight, with respect to the total weight of the mixture, confers a considerable improvement in the stability of the compositions due to the improved solubility of the additive in the lubricating composition.

The invention claimed is:

1. A friction reducer additive (OFR) suitable to be used in lubricating oils, including "Low Saps" and "Mid Saps", and in fuels, said additive not containing metals, sulfur and phosphorus, and being in the form of a mixture of organic compounds comprising an amide, and/or one or more esters of carboxylic acids, and an oxazoline in an amount which varies from 20 to 70% by weight with respect to the total weight of the mixture, wherein the amide (AM-AO) has general formula (III), (III)

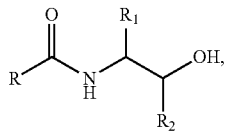

AM-AO the esters (E-AO) have general formula (IV)

(IV)

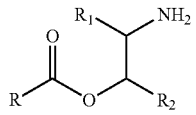

E-AO , and oxazoline (OX-AO) has general formula (V)

(V)

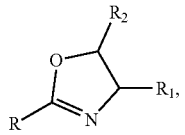

OX-AO wherein R is a group selected from the group consisting of a linear or branched alkyl, or a linear or branched alkenyl, having a number of carbon atoms between 2 and 40;

$R_1$ and $R_2$ groups, which can be the same or different from each other, are independently selected from the group consisting of hydrogen, a hydroxy methyl group (—$CH_2OH$) and hydrocarbon groups based on carbon and hydrogen (and free of heteroatoms), linear or branched, having formula $C_nH_{2n+1}$, $C_nH_{2n}$, $C_nH_n$ wherein "n" is an integer that can vary from 1 to 40.

2. The friction reducer additive according to claim 1, in the form of the mixture of organic compounds, which is the reaction product of a condensation between a fatty carboxylic acid of formula (I), or its mixtures with fatty acids:

(I)

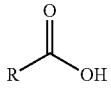

CA wherein

R is a group selected from the group consisting of a linear or branched alkyl, or a linear or branched alkenyl, having a number of carbon atoms comprised between 2 and 40;

with an amino alcohol (AO) of formula (II)

(II)

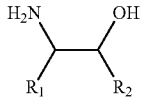

AO wherein $R^1$ and $R_2$ groups, which can be the same or different from each other, are independently selected from the group consisting of hydrogen, a hydroxy methyl group (—$CH_2OH$) and hydrocarbon groups based on carbon and hydrogen (and free of heteroatoms), linear or branched, having the formula: $C_nH_{2n+1}$, $C_nH_{2n}$, $C_nH_n$, where "n" is an integer that can vary from 1 to 40.

3. The friction reducer additive according to claim 2, wherein the amino alcohol (II) is ethanol amine or amino propanediol (enantiomerically pure or in racemic form).

4. The friction reducer additive according to claim 2, wherein the carboxylic acid (I) can be saturated or unsaturated, of vegetable, animal or synthetic origin, selected from the group consisting of capric acid, lauric acid, myristic acid, stearic acid, isostearic acid, arachidic acid, behenic acid and lignoceric acid, lauroleic acid, myristoleic acid, palmitoleic acid, oleic acid, gadoleic acid, erucic acid, linoleic acid and linolenic acid, or mixtures thereof.

5. The friction reducer additive according to claim 2, wherein the carboxylic acid (I) is oleic acid of both animal and vegetable origin, or is a mixture of oleic acid with other carboxylic acids having a composition divided as follows:

| | Animal origin % weight | Vegetable origin % weight | Technical grade oleic acid % weight |
|---|---|---|---|
| Palmitoleic acid | 1.10% | 0.00% | 0.00% |
| Oleic | 83.00% | 89.90% | 96.60% |
| Linoleic | 8.80% | 6.20% | 1.20% |
| Palmiticus | 3.60% | 2.90% | 0.00% |
| Stearic | 1.50% | 1.00% | 2.20% |
| Dioctyl ester of adipic acid | 0.90% | 0.00% | 0.00% |
| $C_{20}$ mono unsaturated | 1.10% | 0.00% | 0.00% |
| Total | 100.00% | 100.00% | 100.00%. |

6. The friction reducer additive according to claim 1, wherein the amide is present at a concentration between 1 and 75% by weight, with respect to the total weight of the mixture, and/or the carboxylic acid ester, or the mixture of esters, is present at a concentration ranging from 1 to 60% by weight with respect to the total weight of the mixture.

7. The friction reducer additive according to claim 1, wherein the mixture includes the following organic compounds:

an amide of formula (VI), (VI)

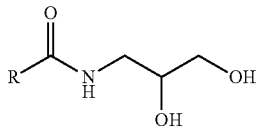

AM-APD and/or a first ester of formula (VII)

(VII)

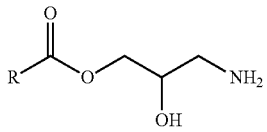

E1-APD and/or a second ester of formula (VIII)

(VIII)

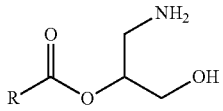

E2-APD and an oxazoline of formula (IX)

(IX)

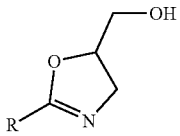

OX-APD wherein R has the meaning previously defined in claim 1.

8. The friction reducer additive according to claim 1, wherein the mixture comprises the following organic compounds:

amide of formula (X)

(X)

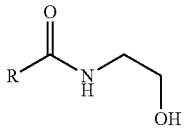

AM-EA and/or ester of formula (XI)

(XI)

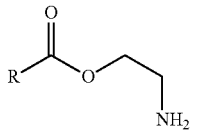

E-EA and oxazoline of formula (XII)

(XII)

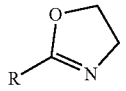

OX-EA wherein R has the meaning previously defined in claim 1.

9. The friction reducer additive according to claim 1, wherein the mixture comprises (% by weight with respect to the total weight of the mixture)

between 30% and 75% of an amide (III); and between 5% and 20% of ester or esters (IV); and between 20% and 50% of oxazoline (V).

10. Lubricating compositions, lubricants for automotive with high fuel economy, lubricants highly compatible with the after-treatment devices of the exhaust gases of motor vehicles for the reduction of pollutant emissions, and lubricants of Otto cycle internal combustion engines, the lubricating compositions comprising:

a mixture of compounds as defined in claim 1, a lubricating base oil, or a mixture of lubricating base oils, selected from base oils of mineral, synthetic, vegetable, animal origin and mixtures thereof.

11. The lubricating compositions according to claim 10, wherein said mixture of compounds (additive) is present at a total concentration comprised between 0.1 and 50% by weight with respect to the weight of the lubricating composition.

* * * * *